US005393062A

United States Patent [19]

Cember

[11] Patent Number: 5,393,062

[45] Date of Patent: Feb. 28, 1995

[54] WORD TRANSFORMATION GAME

[76] Inventor: Richard P. Cember, 1201 Robert E. Lee Rd., Austin, Tex. 78704

[21] Appl. No.: 105,566

[22] Filed: Aug. 13, 1993

[51] Int. Cl.[6] ..... G06F 15/40

[52] U.S. Cl. ..... 273/153 R; 273/272; 273/460; 364/419.11; 364/419.12; 364/419.14; 434/159; 434/167; 434/169; 434/177

[58] Field of Search ..... 273/272, 153 R, 460, 273/429; 434/159, 167, 169, 177; 364/419.08, 419.11, 419.12, 419.14

[56] References Cited

U.S. PATENT DOCUMENTS

| | | | |
|---|---|---|---|
| 3,024,026 | 3/1962 | Goetz | 273/153 R |
| 4,030,211 | 6/1977 | McGinley | 434/167 |
| 4,308,017 | 12/1981 | Laughon et al. | 434/169 |
| 4,891,775 | 1/1990 | McWherter | 434/169 X |
| 4,957,298 | 9/1990 | Silverman | 273/272 X |
| 5,113,340 | 5/1992 | McWherter | 434/169 X |
| 5,148,367 | 9/1992 | Saito | 364/419.12 |
| 5,149,103 | 9/1992 | Ross | 273/432 |
| 5,249,965 | 10/1993 | Vianilos | 434/177 |

OTHER PUBLICATIONS

Dykstra, E. W. "A note on two problems in connexion with graphs" *Numerische Mathematik* (1959).

Gardner, Martin "Bridg-it & Other Games" *Scientific American* (1959).

Knuth, *The Art of Computer Programming* Addison Wesley, Reading, Mass. 1969 pp.44–45.

Kronsjö, Lydia, Algorithms: Their Complexity and Efficiency, Weley, N.Y. 1979 286–287.

*Primary Examiner*—V. Millin

*Assistant Examiner*—Kerry Owens

*Attorney, Agent, or Firm*—Salzman & Levy

[57] ABSTRACT

The present invention is a word game to be played by two or more persons, in which the object of the game is to assemble solutions to word transformation puzzles. The game of the present invention requires the use of a computer (or processor), a display, and a keyboard (or other input device). At the beginning of the game and at various times during the game, the processor must find a solution to a word transformation puzzle or determine that one does not exist. Efficient solution of puzzles by the processor is accomplished by creating two minimum-length search trees, each tree having a number of nodes that contain words generated via a predetermined relationship with respect to one another. The first tree is based on the first Doublet word (the source), while the second tree is based on the second Doublet word (the destination). An intersection of the two search trees is discovered by repeatedly comparing at least one word of the first search tree with at least one word of the second search tree. The nodes of the search trees are stored in memory in such a fashion that the path from the root of the tree to any node may be recovered.

19 Claims, 34 Drawing Sheets

| 169 | 170 | 172 | |
|---|---|---|---|
| L | 1 | word | cord |
| L | 2 | word | ford |
| L | 3 | word | lord |
| L | 4 | word | ward |
| L | 5 | word | wood |
| L | 6 | word | wore |
| L | 7 | word | work |
| L | 8 | word | worm |
| L | 9 | word | worn |
| L | 10 | word | wort |

173

174

| 176 | | |
|---|---|---|
| R | 1 | game | came |
| R | 2 | game | dame |
| R | 3 | game | fame |
| R | 4 | game | gage |
| R | 5 | game | gale |
| R | 6 | game | gams |
| R | 7 | game | gamy |
| R | 8 | game | gape |
| R | 9 | game | gate |
| R | 10 | game | gave |
| R | 11 | game | gaze |
| R | 12 | game | lame |
| R | 13 | game | name |
| R | 14 | game | same |
| R | 15 | game | tame |
| R | 16 | game | mage |

178

180

| | | | | |
|---|---|---|---|---|
| L | 1 | word | cord | card |
| L | 2 | word | cord | coed |
| L | 3 | word | cord | cold |
| L | 4 | word | cord | core |
| L | 5 | word | cord | cork |
| L | 6 | word | cord | corn |
| L | 7 | word | cord | corp |
| L | 8 | word | cord | curd |
| L | 9 | word | ford | fold |
| L | 10 | word | ford | fond |
| L | 11 | word | ford | food |
| L | 12 | word | ford | fore |
| L | 13 | word | ford | fork |
| L | 14 | word | ford | form |
| L | 15 | word | ford | fort |
| L | 16 | word | lord | lard |
| L | 17 | word | lord | load |
| L | 18 | word | lord | lore |
| L | 19 | word | lord | lorn |
| L | 20 | word | lord | lory |
| L | 21 | word | lord | loud |
| L | 22 | word | ward | bard |
| L | 23 | word | ward | hard |
| L | 24 | word | ward | nard |
| L | 25 | word | ward | pard |

195

184

182

186

Figure 10a

| | | | | |
|---|---|---|---|---|
| L | 26 | word | ward | wand |
| L | 27 | word | ward | ware |
| L | 28 | word | ward | wark |
| L | 29 | word | ward | warm |
| L | 30 | word | ward | warn |
| L | 31 | word | ward | warp |
| L | 32 | word | ward | wars |
| L | 33 | word | ward | wart |
| L | 34 | word | ward | wary |
| L | 35 | word | ward | yard |
| L | 36 | word | ward | draw |
| L | 37 | word | wood | good |
| L | 38 | word | wood | hood |
| L | 39 | word | wood | mood |
| L | 40 | word | wood | woof |
| L | 41 | word | wood | wool |
| L | 42 | word | wood | woos |
| L | 43 | word | wore | bore |
| L | 44 | word | wore | gore |
| L | 45 | word | wore | more |
| L | 46 | word | wore | pore |
| L | 47 | word | wore | sore |
| L | 48 | word | wore | tore |
| L | 49 | word | wore | were |
| L | 50 | word | wore | wire |
| L | 51 | word | wore | woke |
| L | 52 | word | wore | wove |
| L | 53 | word | wore | yore |
| L | 54 | word | work | pork |
| L | 55 | word | work | york |
| L | 56 | word | worm | dorm |
| L | 57 | word | worm | norm |
| L | 58 | word | worn | born |
| L | 59 | word | worn | horn |
| L | 60 | word | worn | morn |
| L | 61 | word | worn | porn |
| L | 62 | word | worn | torn |
| L | 63 | word | wort | mort |
| L | 64 | word | wort | port |
| L | 65 | word | wort | sort |
| L | 66 | word | wort | tort |
| L | 67 | word | wort | wert |
| L | 68 | word | wort | wont |
| L | 69 | word | wort | trow |

186

182

| | | | | |
|---|---|---|---|---|
| R | 1 | game | came | cate |
| R | 2 | game | came | cage |
| R | 3 | game | came | cake |
| R | 4 | game | came | camp |
| R | 5 | game | came | cams |
| R | 6 | game | came | cane |
| R | 7 | game | came | cape |
| R | 8 | game | came | care |
| R | 9 | game | came | case |

188

192

196

Figure 10b

| | | | | |
|---|---|---|---|---|
| R | 10 | game | came | cave |
| R | 11 | game | came | come |
| R | 12 | game | came | mace |
| R | 13 | game | came | acme |
| R | 14 | game | dame | dace |
| R | 15 | game | dame | dale |
| R | 16 | game | dame | damn |
| R | 17 | game | dame | damp |
| R | 18 | game | dame | dams |
| R | 19 | game | dame | dare |
| R | 20 | game | dame | date |
| R | 21 | game | dame | daze |
| R | 22 | game | dame | dime |
| R | 23 | game | dame | dome |
| R | 24 | game | dame | edam |
| R | 25 | game | dame | mead |
| R | 26 | game | dame | made |
| R | 27 | game | fame | face |
| R | 28 | game | fame | fade |
| R | 29 | game | fame | fake |
| R | 30 | game | fame | fare |
| R | 31 | game | fame | fate |
| R | 32 | game | fame | faze |
| R | 33 | game | fame | fume |
| R | 34 | game | gage | gaga |
| R | 35 | game | gage | gags |
| R | 36 | game | gage | page |
| R | 37 | game | gage | rage |
| R | 38 | game | gage | sage |
| R | 39 | game | gage | wage |
| R | 40 | game | gale | bale |
| R | 41 | game | gale | gala |
| R | 42 | game | gale | gall |
| R | 43 | game | gale | gals |
| R | 44 | game | gale | hale |
| R | 45 | game | gale | kale |
| R | 46 | game | gale | male |
| R | 47 | game | gale | pale |
| R | 48 | game | gale | sale |
| R | 49 | game | gale | tale |
| R | 50 | game | gale | vale |
| R | 51 | game | gale | wale |
| R | 52 | game | gale | yale |
| R | 53 | game | gams | gabs |
| R | 54 | game | gams | gaps |
| R | 55 | game | gams | gars |
| R | 56 | game | gams | gats |
| R | 57 | game | gams | gays |
| R | 58 | game | gams | gems |
| R | 59 | game | gams | gums |
| R | 60 | game | gams | gyms |
| R | 61 | game | gams | hams |
| R | 62 | game | gams | jams |
| R | 63 | game | gams | lams |

192

188

194

Figure 10c

| | | | | |
|---|---|---|---|---|
| R | 64 | game | gams | rams |
| R | 65 | game | gams | tams |
| R | 66 | game | gams | yams |
| R | 67 | game | gams | mags |
| R | 68 | game | gamy | gapy |
| R | 69 | game | gape | jape |
| R | 70 | game | gape | nape |
| R | 71 | game | gape | rape |
| R | 72 | game | gape | tape |
| R | 73 | game | gate | bate |
| R | 74 | game | gate | hate |
| R | 75 | game | gate | late |
| R | 76 | game | gate | mate |
| R | 77 | game | gate | pate |
| R | 78 | game | gate | rate |
| R | 79 | game | gate | sate |
| R | 80 | game | gate | tate |
| R | 81 | game | gave | eave |
| R | 82 | game | gave | give |
| R | 83 | game | gave | gyve |
| R | 84 | game | gave | have |
| R | 85 | game | gave | lave |
| R | 86 | game | gave | nave |
| R | 87 | game | gave | pave |
| R | 88 | game | gave | rave |
| R | 89 | game | gave | save |
| R | 90 | game | gave | wave |
| R | 91 | game | gaze | haze |
| R | 92 | game | gaze | laze |
| R | 93 | game | gaze | maze |
| R | 94 | game | gaze | raze |
| R | 95 | game | lame | lace |
| R | 96 | game | lame | lade |
| R | 97 | game | lame | lake |
| R | 98 | game | lame | lama |
| R | 99 | game | lame | lamb |
| R | 100 | game | lame | lamp |
| R | 101 | game | lame | lane |
| R | 102 | game | lame | lime |
| R | 103 | game | lame | meal |
| R | 104 | game | name | nome |
| R | 105 | game | name | mean |
| R | 106 | game | name | amen |
| R | 107 | game | name | mane |
| R | 108 | game | same | safe |
| R | 109 | game | same | sake |
| R | 110 | game | same | sane |
| R | 111 | game | same | some |
| R | 112 | game | same | mesa |
| R | 113 | game | same | seam |
| R | 114 | game | tame | take |
| R | 115 | game | tame | tamp |
| R | 116 | game | tame | tare |
| R | 117 | game | tame | time |

188

194

Figure 10d

| | | | | |
|---|---|---|---|---|
| R | 118 | game | tame | tone |
| R | 119 | game | tame | meat |
| R | 120 | game | tame | meta |
| R | 121 | game | tame | team |
| R | 122 | game | mage | magi |
| R | 123 | game | mage | make |
| R | 124 | game | mage | mare |

188

194

Figure 10E 210 212 214 216

| | | | |
|---|---|---|---|
| L | cord | 1 | word |
| L | ford | 1 | word |
| L | lord | 1 | word |
| L | ward | 1 | word |
| L | wood | 1 | word |
| L | word | 0 | |
| L | wore | 1 | word |
| L | work | 1 | word |
| L | worm | 1 | word |
| L | worn | 1 | word |
| L | wort | 1 | word |

220 218

224 226 228

| | | | |
|---|---|---|---|
| R | came | 1 | game |
| R | dame | 1 | game |
| R | fame | 1 | game |
| R | gage | 1 | game |
| R | gale | 1 | game |
| R | game | 0 | |
| R | gams | 1 | game |
| R | gamy | 1 | game |
| R | gape | 1 | game |
| R | gate | 1 | game |
| R | gave | 1 | game |
| R | gaze | 1 | game |
| R | lame | 1 | game |
| R | mage | 1 | game |
| R | name | 1 | game |
| R | same | 1 | game |
| R | tame | 1 | game |

222

234 232 236 238 240

| | | | |
|---|---|---|---|
| L | bard | 2 | ward |
| L | bore | 2 | wore |
| L | born | 2 | worn |
| L | card | 2 | cord |
| L | coed | 2 | cord |
| L | cold | 2 | cord |
| L | cord | 1 | word |
| L | core | 2 | cord |
| L | cork | 2 | cord |
| L | corn | 2 | cord |
| L | corp | 2 | cord |
| L | curd | 2 | cord |
| L | dorm | 2 | worm |
| L | draw | 2 | ward |
| L | fold | 2 | ford |
| L | fond | 2 | ford |
| L | food | 2 | ford |
| L | ford | 1 | word |
| L | fore | 2 | ford |
| L | fork | 2 | ford |
| L | form | 2 | ford |

230

Figure 12a

| | | | |
|---|---|---|---|
| L | fort | 2 | ford |
| L | good | 2 | wood |
| L | gore | 2 | wore |
| L | hard | 2 | ward |
| L | hood | 2 | wood |
| L | horn | 2 | worn |
| L | lard | 2 | lord |
| L | load | 2 | lord |
| L | lord | 1 | word |
| L | lore | 2 | lord |
| L | lorn | 2 | lord |
| L | lory | 2 | lord |
| L | loud | 2 | lord |
| L | mood | 2 | wood |
| L | more | 2 | wore |
| L | morn | 2 | worn |
| L | mort | 2 | wort |
| L | nard | 2 | ward |
| L | norm | 2 | worm |
| L | pard | 2 | ward |
| L | pore | 2 | wore |
| L | pork | 2 | work |
| L | porn | 2 | worn |
| L | port | 2 | wort |
| L | sore | 2 | wore |
| L | sort | 2 | wort |
| L | tore | 2 | wore |
| L | torn | 2 | worn |
| L | tort | 2 | wort |
| L | trow | 2 | wort |
| L | wand | 2 | ward |
| L | ward | 1 | word |
| L | ware | 2 | ward |
| L | wark | 2 | ward |
| L | warm | 2 | ward |
| L | warn | 2 | ward |
| L | warp | 2 | ward |
| L | wars | 2 | ward |
| L | wart | 2 | ward |
| L | wary | 2 | ward |
| L | were | 2 | wore |
| L | wert | 2 | wort |
| L | wire | 2 | wore |
| L | woke | 2 | wore |
| L | wont | 2 | wort |
| L | wood | 1 | word |
| L | woof | 2 | wood |
| L | wool | 2 | wood |
| L | woos | 2 | wood |
| L | word | 0 | |
| L | wore | 1 | word |
| L | work | 1 | word |
| L | worm | 1 | word |
| L | worn | 1 | word |

230

242

Figure 12b

| | | | | |
|---|---|---|---|---|
| | L | wort | 1 | word |
| | L | wove | 2 | wore |
| | L | yard | 2 | ward |
| | L | yore | 2 | wore |
| | L | york | 2 | work |
| | R | acme | 2 | came |
| | R | amen | 2 | name |
| | R | bale | 2 | gale |
| | R | bate | 2 | gate |
| | R | cafe | 2 | came |
| | R | cage | 2 | came |
| 248 | R | cake | 2 | came |
| | R | came | 1 | game |
| | R | camp | 2 | came |
| | R | cams | 2 | came |
| | R | cane | 2 | came |
| 244 | R | cape | 2 | came |
| | R | care | 2 | came |
| | R | case | 2 | came |
| | R | cave | 2 | came |
| | R | come | 2 | came |
| | R | dace | 2 | dame |
| | R | dale | 2 | dame |
| | R | dame | 1 | game |
| | R | damn | 2 | dame |
| | R | damp | 2 | dame |
| | R | dams | 2 | dame |
| | R | dare | 2 | dame |
| | R | date | 2 | dame |
| | R | daze | 2 | dame |
| | R | dime | 2 | dame |
| | R | dome | 2 | dame |
| | R | eave | 2 | gave |
| | R | edam | 2 | dame |
| | R | face | 2 | fame |
| | R | fade | 2 | fame |
| | R | fake | 2 | fame |
| | R | fame | 1 | game |
| | R | fare | 2 | fame |
| | R | fate | 2 | fame |
| | R | faze | 2 | fame |
| | R | fume | 2 | fame |
| | R | gabs | 2 | gams |
| | R | gaga | 2 | gage |
| | R | gage | 1 | game |
| | R | gags | 2 | gage |
| | R | gala | 2 | gale |
| | R | gale | 1 | game |
| | R | gall | 2 | gale |
| | R | gals | 2 | gale |
| | R | game | 0 | |
| | R | gams | 1 | game |
| | R | gamy | 1 | game |

230

250

246

Figure 12c

| | | | |
|---|---|---|---|
| R | gape | 1 | game |
| R | gaps | 2 | gams |
| R | gapy | 2 | gamy |
| R | gars | 2 | gams |
| R | gate | 1 | game |
| R | gats | 2 | gams |
| R | gave | 1 | game |
| R | gays | 2 | gams |
| R | gaze | 1 | game |
| R | gems | 2 | gams |
| R | give | 2 | gave |
| R | gums | 2 | gams |
| R | gyms | 2 | gams |
| R | gyve | 2 | gave |
| R | hale | 2 | gale |
| R | hams | 2 | gams |
| R | hate | 2 | gate |
| R | have | 2 | gave |
| R | haze | 2 | gaze |
| R | jams | 2 | gams |
| R | jape | 2 | gape |
| R | kale | 2 | gale |
| R | lace | 2 | lame |
| R | lade | 2 | lame |
| R | lake | 2 | lame |
| R | lama | 2 | lame |
| R | lamb | 2 | lame |
| R | lame | 1 | game |
| R | lamp | 2 | lame |
| R | lams | 2 | gams |
| R | lane | 2 | lame |
| R | late | 2 | gate |
| R | lave | 2 | gave |
| R | laze | 2 | gaze |
| R | lime | 2 | lame |
| R | mace | 2 | came |
| R | made | 2 | dame |
| R | mage | 1 | game |
| R | magi | 2 | mage |
| R | mags | 2 | gams |
| R | make | 2 | mage |
| R | male | 2 | gale |
| R | mane | 2 | name |
| R | mare | 2 | mage |
| R | mate | 2 | gate |
| R | maze | 2 | gaze |
| R | mead | 2 | dame |
| R | meal | 2 | lame |
| R | mean | 2 | name |
| R | meat | 2 | tame |
| R | mesa | 2 | same |
| R | meta | 2 | tame |
| R | name | 1 | game |
| R | nape | 2 | gape |

Figure 12d

| | | | |
|---|---|---|---|
| R | nave | 2 | gave |
| R | nome | 2 | name |
| R | page | 2 | gage |
| R | pale | 2 | gale |
| R | pate | 2 | gate |
| R | pave | 2 | gave |
| R | rage | 2 | gage |
| R | rams | 2 | gams |
| R | rape | 2 | gape |
| R | rate | 2 | gate |
| R | rave | 2 | gave |
| R | raze | 2 | gaze |
| R | safe | 2 | same |
| R | sage | 2 | gage |
| R | sake | 2 | same |
| R | sale | 2 | gale |
| R | same | 1 | game |
| R | sane | 2 | same |
| R | sate | 2 | gate |
| R | save | 2 | gave |
| R | seam | 2 | same |
| R | some | 2 | same |
| R | take | 2 | tame |
| R | tale | 2 | gale |
| R | tame | 1 | game |
| R | tamp | 2 | tame |
| R | tams | 2 | gams |
| R | tape | 2 | gape |
| R | tare | 2 | tame |
| R | tate | 2 | gate |
| R | team | 2 | tame |
| R | time | 2 | tame |
| R | tome | 2 | tame |
| R | vale | 2 | gale |
| R | wage | 2 | gage |
| R | wale | 2 | gale |
| R | wave | 2 | gave |
| R | yale | 2 | gale |
| R | yams | 2 | gams |

Figure 12E

WORD TRANSFORMATION GAME

BACKGROUND OF THE INVENTION

The present invention pertains to computer-processor-based word games and amusements and, more particularly, to a word game in which the object is to transform a first, N-character word into a second, N-character word, through a sequence of intermediate words, according to certain rules.

DESCRIPTION OF THE PRIOR ART

In 1879 the Reverend Charles L. Dodgson, author of the famous children's books *Alice in Wonderland* and *Through the Looking Glass*, and better known by the pseudonym "Lewis Carroll", published a new type of word puzzle which he called "Doublets". A Doublet was a pair of words composed of the same number of letters, generally related in meaning in some way, sometimes embedded in a brief phrase. A solution of a puzzle was a sequence of words, each word composed of the same number of letters as the two puzzle words, the sequence beginning and ending with the two puzzle words. Each word in the sequence was to be derived from the one preceding it by the substitution of one single letter. Many puzzles had more than one solution; for a given puzzle the solution containing the fewest steps was deemed to be the best.

In 1892, Carroll introduced a second allowed transformation, in addition to the substitution of one single letter. Now the "Doubleteers" (as Carroll called his puzzle audience) were also permitted to permute the letters of a word. The version of 1892 vastly increased the number of possible puzzles and solutions. Hereafter, in this document the term "Doublets" will refer to the 1892 version of the puzzle. Also, hereafter, in this document the phrase "Doublets transformation rules" will refer to the substitutions and permutations permitted under the 1892 version of Doublets.

The allowed glossary or lexicon for solution of an English language Doublets puzzle of N letters consists of all English words that are N letters in length and that are not proper nouns, abbreviations, contractions, or hyphenated words. The puzzle author (or the Doubleteer) adopts some standard dictionary as the arbiter of precisely what words are to be considered as elements of the lexicon.

It would be very desirable to define a strategic word game around Doublets puzzles.

For persons with some mathematical training or intuition, experience with Doublets often suggests that the set of N-letter English words can be considered as a graph, in which each word is a node. Two nodes in the graph are connected by an edge if they may be used in sequence in a puzzle solution under the Doublets transformation rules. The two puzzle words may be called the "terminal nodes". The problem of solving a Doublets puzzle is equivalent to that of finding a path through the graph that connects the terminal nodes. The problem of achieving an optimal solution (i.e., a solution in the fewest possible steps) is that of finding a route between the terminal nodes that touches upon the fewest possible intermediate nodes.

In "A Note on Two Problems in Connexion with Graphs" by E. W. Dijkstra (*Numerische Mathematik*, 1, 269–271, 1959) a method of solution is disclosed for the shortest-path problem in a graph when all edge lengths are of the same algebraic sign. This class of problems includes the Doublets problem as that special case of the shortest-path problem in which all edges are of equal length. Though over thirty years old, the method of Djikstra is still considered to be very efficient for the class of problems that it addresses.

Dijkstra's method will work for solution of Doublets puzzles, but experience shows that for the large graphs that are constituted by the sets of 3-, 4-, and 5-letter English words under the Doublets transformation rules, the Djikstra method is too slow, and requires too much memory for practical implementation on contemporary low-cost processors.

For purposes of a game to be implemented using a low-cost processor and a small memory, it would be desirable to develop a faster and more memory-efficient method of solving Doublets puzzles.

A "switching game" attributed to the information theorist Claude E. Shannon may be described as follows: Two individuals, a "cut" player and a "short" player, play a game on a graph. They single out two nodes called the terminals. The cut player makes a move by deleting an edge of the graph. The short player in his turn makes a move by designating an edge which cannot be deleted. The object for the short player is to maintain a sequence of non-repeating edges between the terminals, while the cut player attempts to break all such sequences.

The Shannon switching game per se is unsuitable as the basis for a strategic game in which the nodes are words and the Doublets transformation rules define the edges in the graph, for three reasons. First, the distinction between the "cut" player and the "short" player introduces an undesirable asymmetry between the two players. Second, the Shannon switching game allows for only two players and no more. Third, the Shannon switching game deletes or protects edges, whereas in a Doublets graph there is no meaningful sense in which edges can be deleted or protected, because the edges are derived from the Doublets transformation rules. Any protection or deletion in a Doublets-based graph game must be applied to the nodes (i.e., the words).

Experience with Doublets suggests that application of some kind of protection-and-deletion scheme to the graph of N-letter English words under the Doublets transformation rules, in such a fashion as to formulate a strategic game, would yield a game with a rich potential for maneuver, surprise and uncertainty. This is very desirable in a strategic game.

A strategic board game that has some significant similarities to the Shannon switching game is described by Martin Gardner in *Martin Gardner's New Mathematical Diversions from Scientific American* (University of Chicago Press, 1983). According to Gardner, the game was devised by a mathematician at Brown University named David Gale, and was introduced by Gardner as "the game of Gale" in his monthly column on mathematical games in the October 1958 edition of Scientific American. U.S. Pat. No. 3,024,026 discloses a physical embodiment of a game board upon which the game of Gale may be played.

The graph of N-letter words connected under the Doublets transformation rules is large, irregular, and implicit in the human mind, rather than small, regular and visually explicit, as is the graph in which the game of Gale is played. As a result, the potential for maneuver, surprise and uncertainty in a strategic game played in the graph of N-letter words under the Doublets transformation rules is intrinsically greater than is possible even with so ingenious a board game as the game of Gale.

Word games make up only a tiny fraction of the existing library of computer-based games. The most prominent among existing word games for the computer is Scrabble® (Virgin Games, Inc., "The Computer Edition of Scrabble", Irvine, Calif., 1986). Scrabble® became famous in the 1940s as a board game with wooden letter tiles and tile racks. Its play on the computer adds the optional participation of the computer itself as a player. Certain elements of the board game, such as the secrecy of each player's rack of tiles, are sacrificed by presentation on the computer display instead of in the traditional rack-and-tile format. As a result, many continue to prefer the board game.

"Wordtris" TM (Spectrum Holobyte, Inc., Alameda, Calif., 1991) is a word-oriented variation on the popular game of "Tetris" TM (Spectrum Holobyte, Inc., 1987). In Wordtris TM, the player seeks to place falling letters in such a fashion as to form words in the down or across directions. When the player forms words from the falling letters, he receives points and the letters of the newly formed word disappear. Letters that are not placed so as to form words pile up and accumulate in an area called the "well". As the player successfully forms some words, the letters fall ever more rapidly. Eventually, the letters accumulate more rapidly than even a highly skilled player can make words. The well fills up and the game is then over. The more words that a player can form before he is finally overwhelmed and the game ends, the higher his score. The basic mode of play is solitaire, but competitive and cooperative modes are also available, in which two letters fall at a time.

WordTris TM is innovative in that it is a word game that can be played only on a computer—it is not a word game dating from pre-computer times that merely uses the computer as a fundamentally unnecessary substitute for board, tiles, dictionary, etc.

It would be very desirable to increase the existing repertory of computer-based word games which make essential use of the unique capabilities of the computer.

In another respect, Wordtris TM conforms to one of the common general categories of games designed for use on the computer. This category may be described as the action category, which includes battle games (for example, "Spectre TM", by Baker and Taylor Software) and obstacle games (for example, the "Mario Brothers TM" series, by Nintendo of America, Inc.). In action-type games, the player must take quick, dexterous actions in response to sudden events occurring on-screen. These events occur at times and in a manner determined by the computer, with the tempo and the character of the events intensifying until the player is overwhelmed.

It would be desirable to create a computer-based word game which departs from the action category and other existing categories of computer games.

SUMMARY OF THE INVENTION

The present invention is a word game to be played by two or more persons, in which the object of the game is to assemble solutions to word transformation puzzles. The game of the present invention requires the use of a computer (or processor), a display, and a keyboard (or other input device). At the beginning of the game and at various times during the game, the processor must find a solution to a word transformation puzzle or determine that one does not exist. Efficient solution of puzzles by the processor is accomplished by creating two minimum-length search trees, each tree having a number of nodes that contain words generated via a predetermined relationship with respect to one another. The first tree is based on the first Doublet word (the source), while the second tree is based on the second Doublet word (the destination). An intersection of the two search trees is discovered by repeatedly comparing at least one word of the first search tree with at least one word of the second search tree. The nodes of the search trees are stored in memory in such a fashion that the path from the root of the tree to any node may be recovered.

BRIEF DESCRIPTION OF THE DRAWINGS

A complete understanding of the present invention may be obtained by reference to the accompanying drawings, when taken in conjunction with the detailed description thereof and in which:

FIG. 6, are a flow chart depicting the method of puzzle solution using two minimum-length trees;

FIG. 7, are a flow chart containing an abbreviated version of the flow chart of FIGS. 6*a*–6*d;*

FIGS. 10*a*–10*e*, taken together to form FIG. 10, depict an example of the storage in memory of the two minimum-length trees using the scheme depicted in FIG. 9;

FIGS. 12*a*–12*e*, taken together to form FIG. 12, depict an example of the storage in memory of the two minimum-length trees using the scheme depicted in FIG. 11;

FIG. 14, depict a flow chart depicting the sequence of actions by which the processor conducts the game;

DETAILED DESCRIPTION OF THE PREFERRED EMBODIMENT

Figure 1:
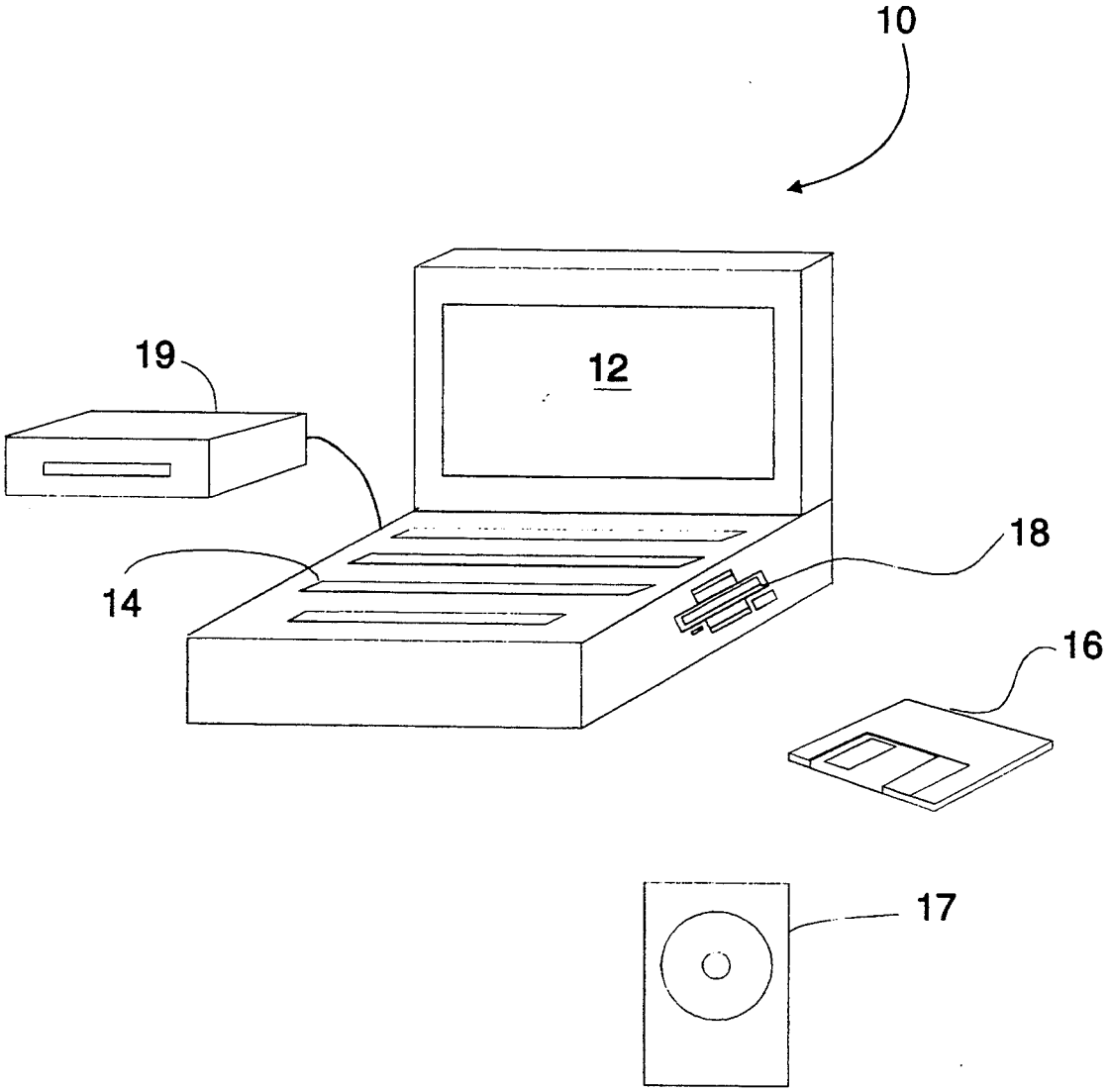
FIG. 1 depicts schematically the preferred physical embodiment of the game in accordance with the present invention.

Referring now to FIG. 1, the game of the present invention may take a number of physical forms, the preferred one being a general-purpose computer 10 with a screen 12 and keyboard 14, such as a personal computer. The game is embodied in the computer 10 by placing a copy of an executable game program (not shown) onto the fixed disk (not shown) of the computer 10, or onto a diskette 16 or optical compact disk 17 which is then inserted into the diskette drive 18 or optical compact disk drive 19. The game is activated by issuing a suitable command to the computer's operating system.

Figure 2:
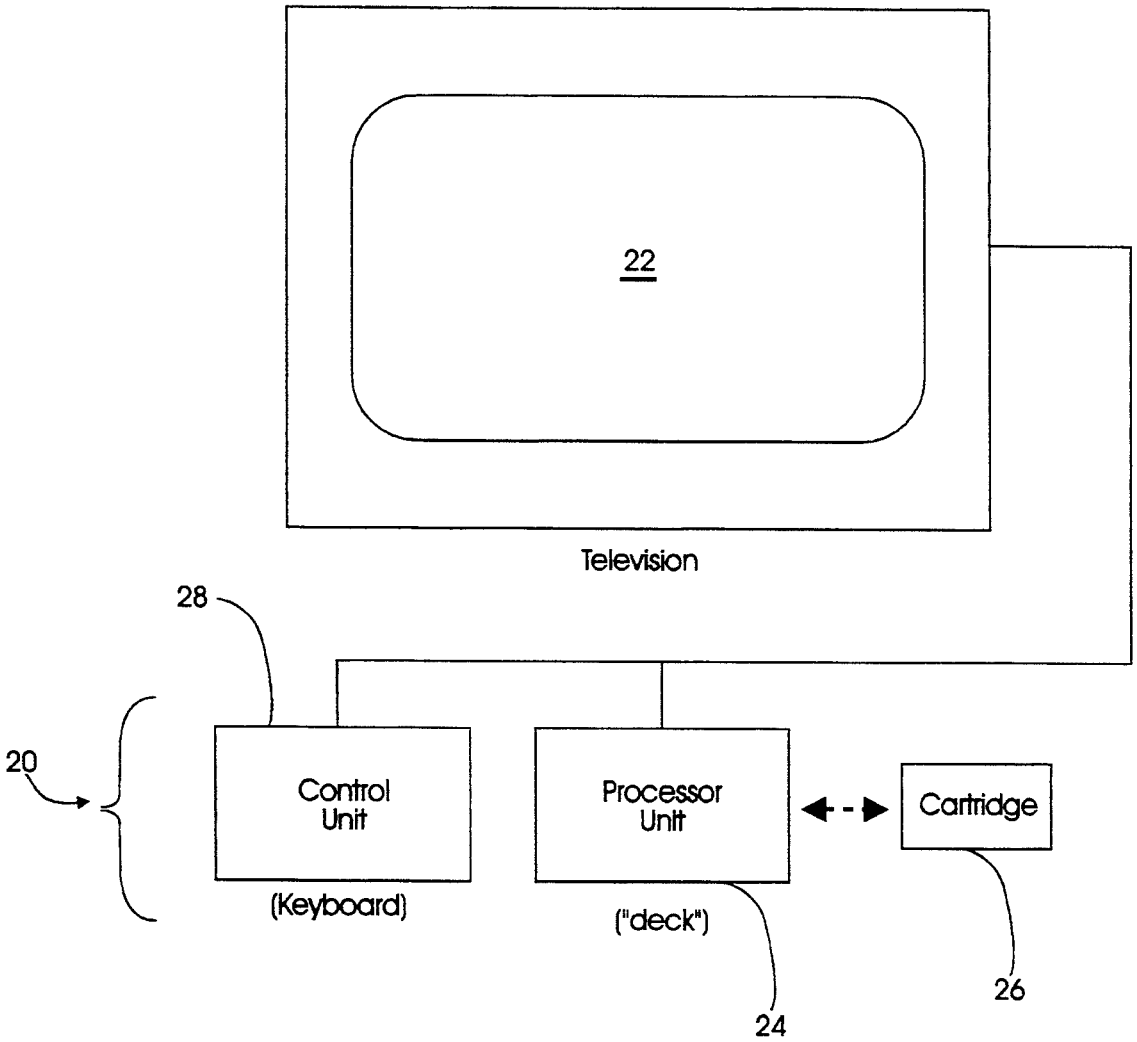
FIG. 2 depicts schematically an alternate embodiment of the game; namely, as software embodied in a game device system that uses a standard monitor or television set as a display.

Referring now to FIG. 2, there is shown an alternate embodiment of the invention. A device 20 contains a display 22, a processor 24, a cartridge, diskette, optical compact disk reader or other replaceable data medium 26, and a keyboard 28. Device 20 is a special-purpose system designed to operate games. Examples of such a special-purpose system are the "Nintendo" brand system and the "Sega" brand system, which use a standard television set as a display 22. These particular systems are not equipped with keyboards. However, a variety of special control devices is available separately for various gaming purposes. To this group of available separate controllers could be added a keyboard 28, sold as equipment for the present game.

Figure 3:
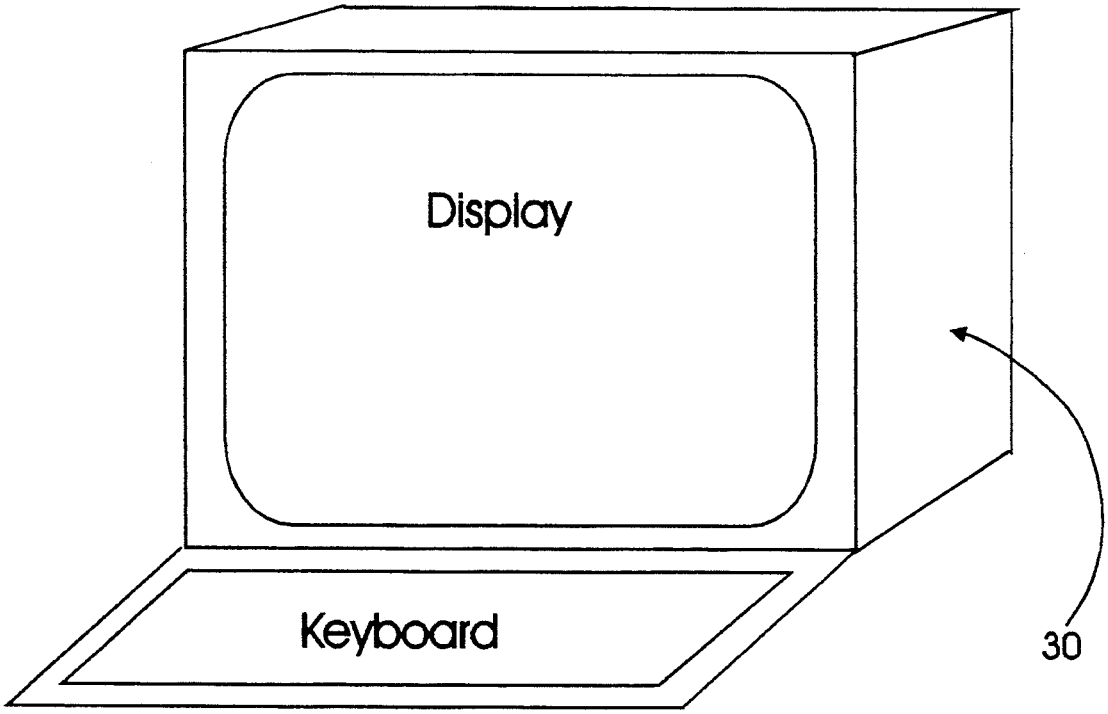
FIG. 3 depicts schematically another embodiment; namely, as a stand-alone device, containing a processor; a display, and a keyboard or other means of input.

Referring now to FIG. 3, there is shown a device 30 which is specifically manufactured to embody the inventive game. Examples of devices of this class embodying a game other than the present invention are self-contained electronic chess games that are sold in stores in today.

Finally, an embodiment may be created which combines elements of the above three embodiments. For example, a game device may be manufactured that does not receive a cartridge or diskette, that is manufactured solely for the purpose of containing the game described hereinbelow, and that uses a standard television set as a display.

In any of the three foregoing embodiments, or in any other, the processor must carry out tasks which may be divided into two groups: (a) general conduct of the game, as described hereinbelow with respect to the rules of the game; and (b) solution of puzzles under a given list of available words, specifically, either the lexicon of N-letter words, or the list of saved words, as described in greater detail hereinbelow with respect to the rules of the game.

The method used in the present invention for the solution of the puzzles makes the solution fast enough and memory-efficient enough so that the game may be run on an IBM-compatible personal computer with a 486-type processor and 640 kilobytes of random access memory. The inventive method and the aforementioned Dijkstra method are both "shortest-path tree" methods. The shortest-path tree used in the method employed in the present invention is diagrammed in FIG. 4, in which nodes are represented as circles and edges as lines. The root of the tree 31 is one of the two terminal nodes, and is designated as level 1. The nodes of level 2, described by reference numeral 32, are all the nodes that are connected to the root node 31 under the Doublets transformation rules. Level 3, described by reference numeral 33, is "grown" as follows: First, let all nodes connected under the the Doublets transformation rules to the leftmost node 34 of level 2, except those present in level 2 or in level 1, become nodes 33 in level 3; then let all nodes connected under the Doublets transformation rules to the second node from the left 35 in level 2, except those present in level 2 or level 1, or those already present in level 3, become additional nodes 33 in level 3. Continue in this manner until level 3 contains all nodes 33 that are (a) connected under the Doublets transformation rules to the nodes 32 of level 2 and (b) not already present in levels 1 or 2. Level 4, not shown, is grown in a similar manner from level 3; level 5, not shown, is grown similarly from level 4; and so forth, until tree growth is halted, as described hereinbelow.

The exclusion of any node already present in the tree from being added to the tree a second time is important, as it avoids the creation of ciruits, and the conversion of the tree into a network.

Figure 4:
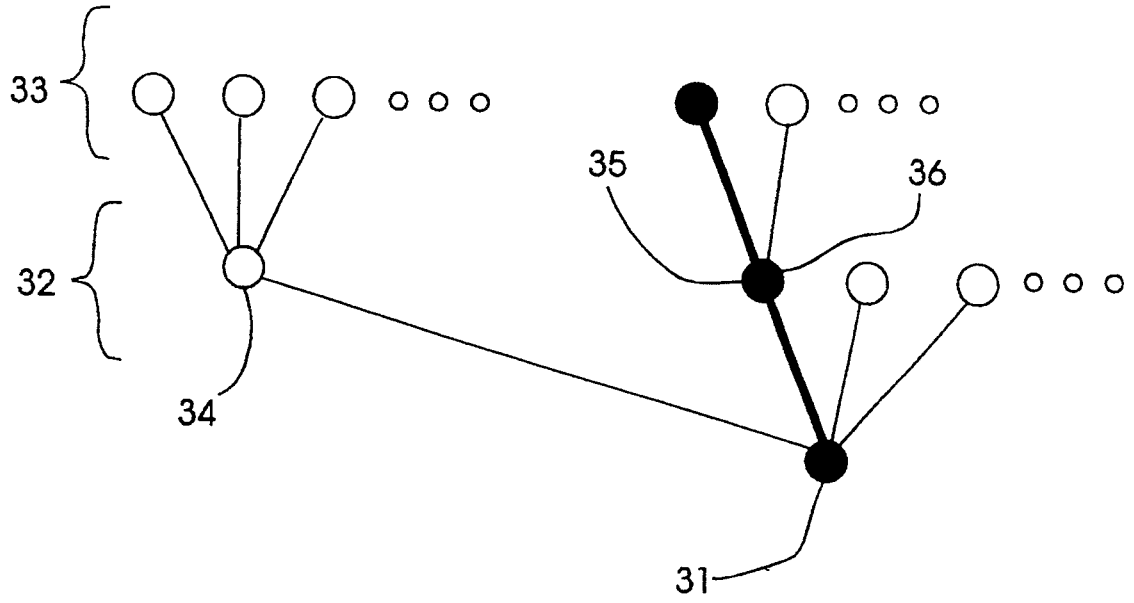
FIG. 4 depicts schematically the structure of the minimum-length trees used in the puzzle-solution method of the invention.

In the development of a tree containing M levels (the Mth level may be incomplete and still in the process of growth), a "path" is defined as a sequence of M connected nodes from level 1 to level M. In the tree of FIG. 4, which contains three levels, the sequence of nodes connected by the bold line 36 form a path. There are as many paths in a tree of M complete levels as there are nodes in the Mth level. A "partial path" is defined as a sequence of M' connected nodes from level 1 to level M', where M' is less than or equal to M.

In the Doublets problem, unlike the more general class of problems which the Dijkstra method addresses, the distance between any two nodes in the graph of the N-letter lexicon under the Doublets transformation rules is simply the number of edges forming the path that joins the two nodes. The above method of growing a tree guarantees that there is no route from the tree's root to any node of the tree that is shorter than the partial path embedded in the tree; the first time in the course of growing the tree that any node appears in a tree, an optimal route from the root to that node has been found.

It is this last fact which permits a great improvement over the prior art. Instead of one tree, as in the Dijkstra method, two trees may be used in the solution of a Doublets puzzle, one tree grown from each terminal node. The first appearance in either tree of any node already present in the other tree marks the successful termination of the method in the finding of an optimal solution; after that, the two paths need only be spliced together at their common node to complete the solution. The method terminates unsuccessfully if either tree cannot be grown any further and there are no nodes that are present in both trees, indicating that no solution exists.

Figure 5:
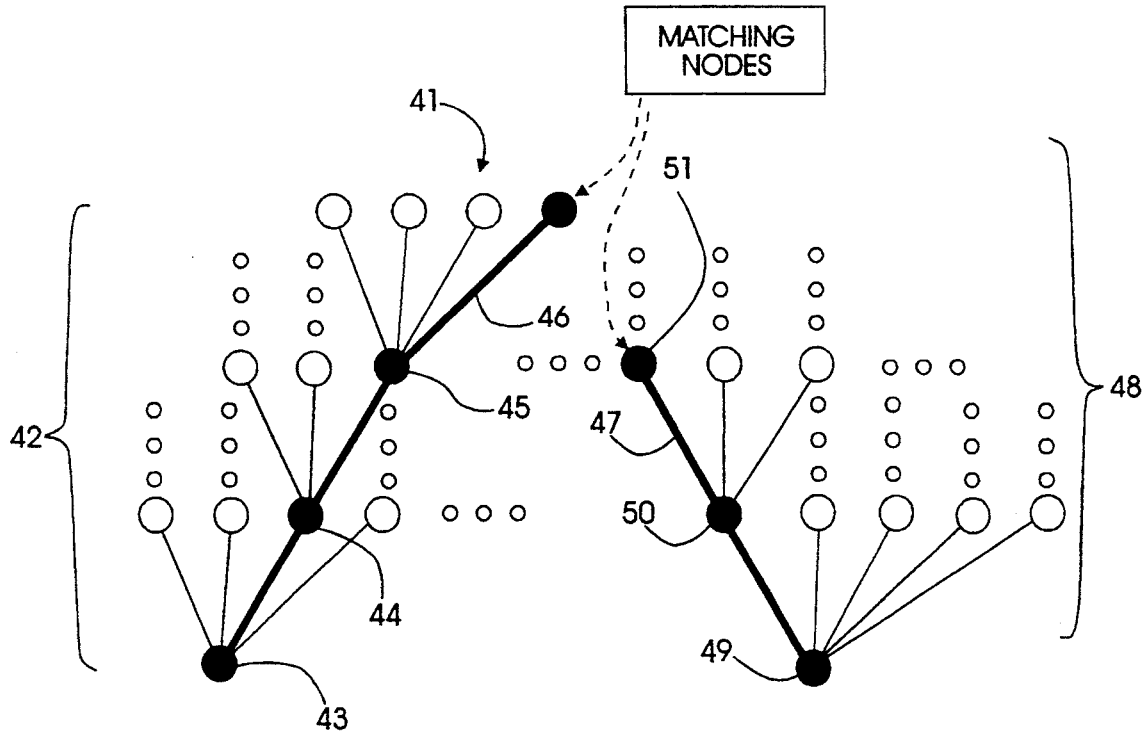
FIG. 5 depicts schematically the manner in which two minimum-length trees are used together in the puzzle-solution method.
Figure 6A:
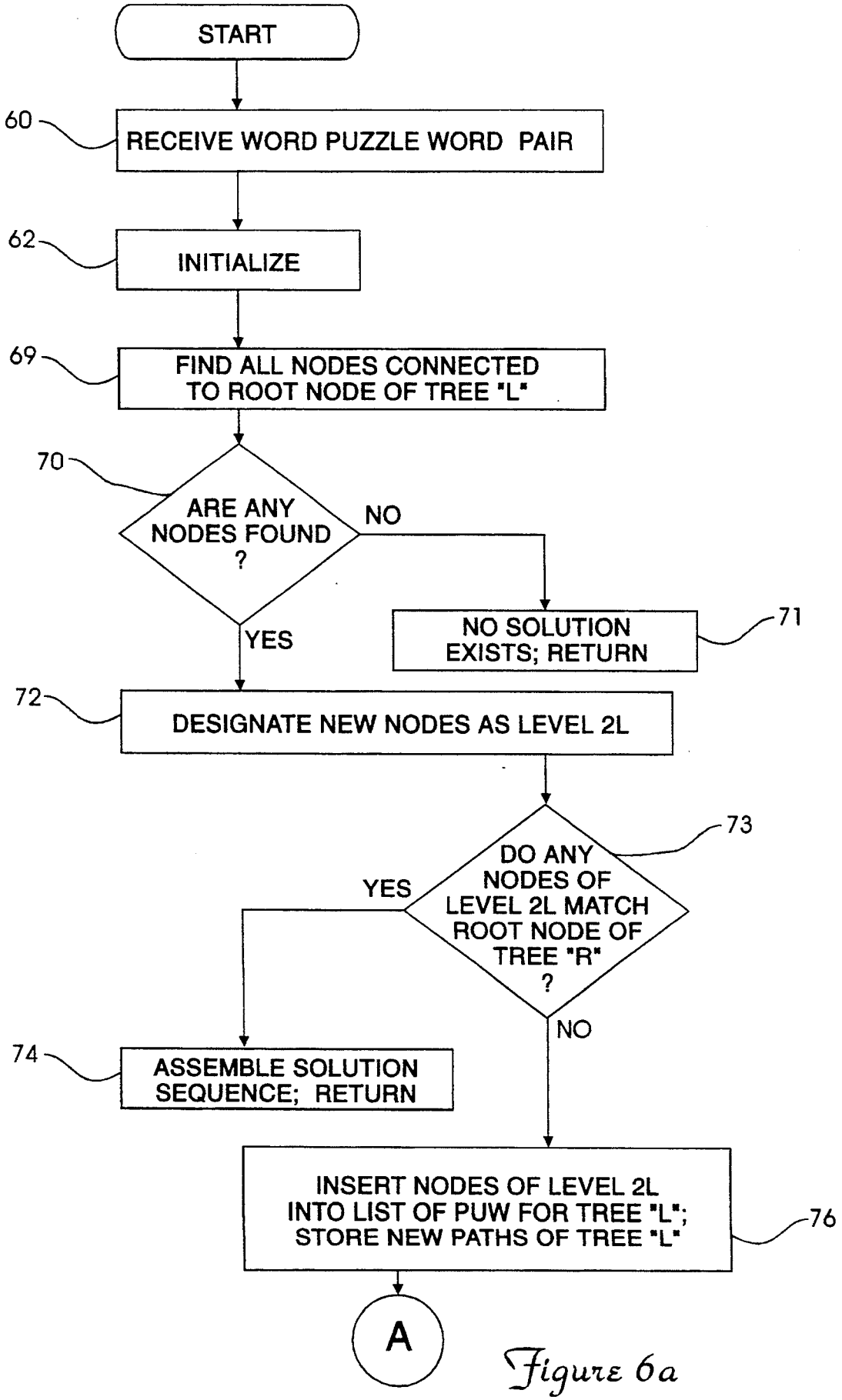
FIGS. 6*a*–6*d*, taken together to form
Figure 6B:
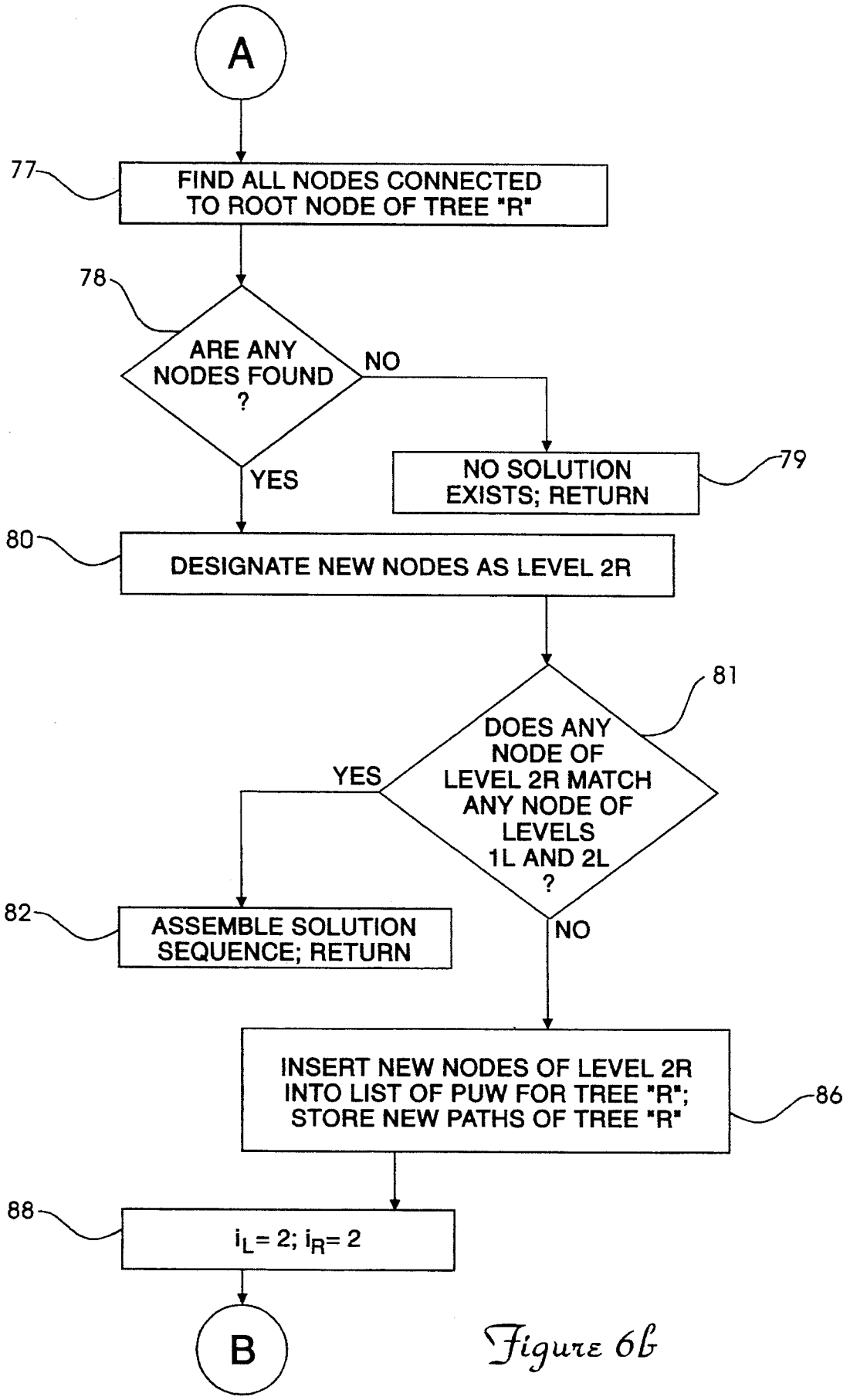
Figure 6C:
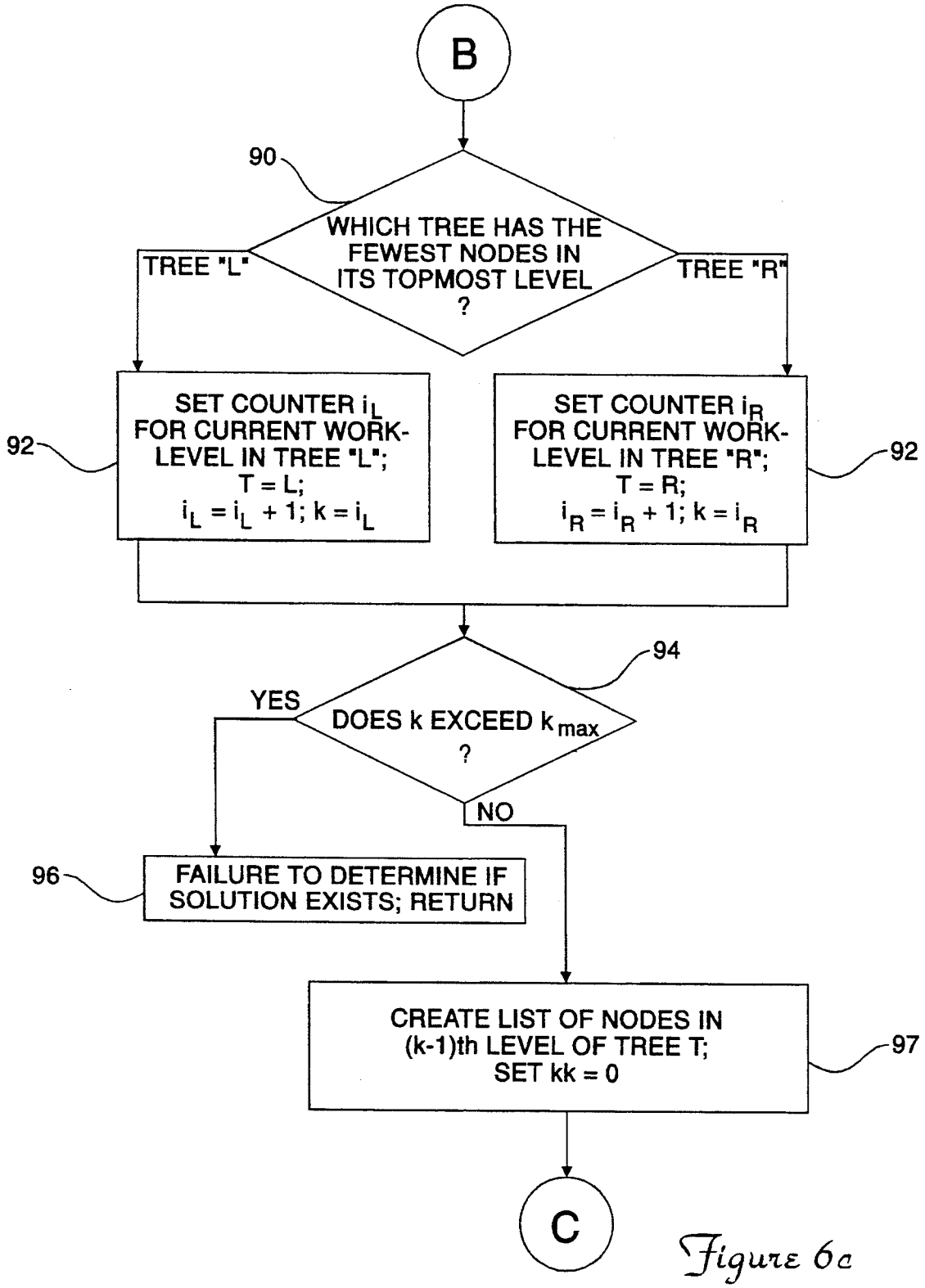
Figure 6D:
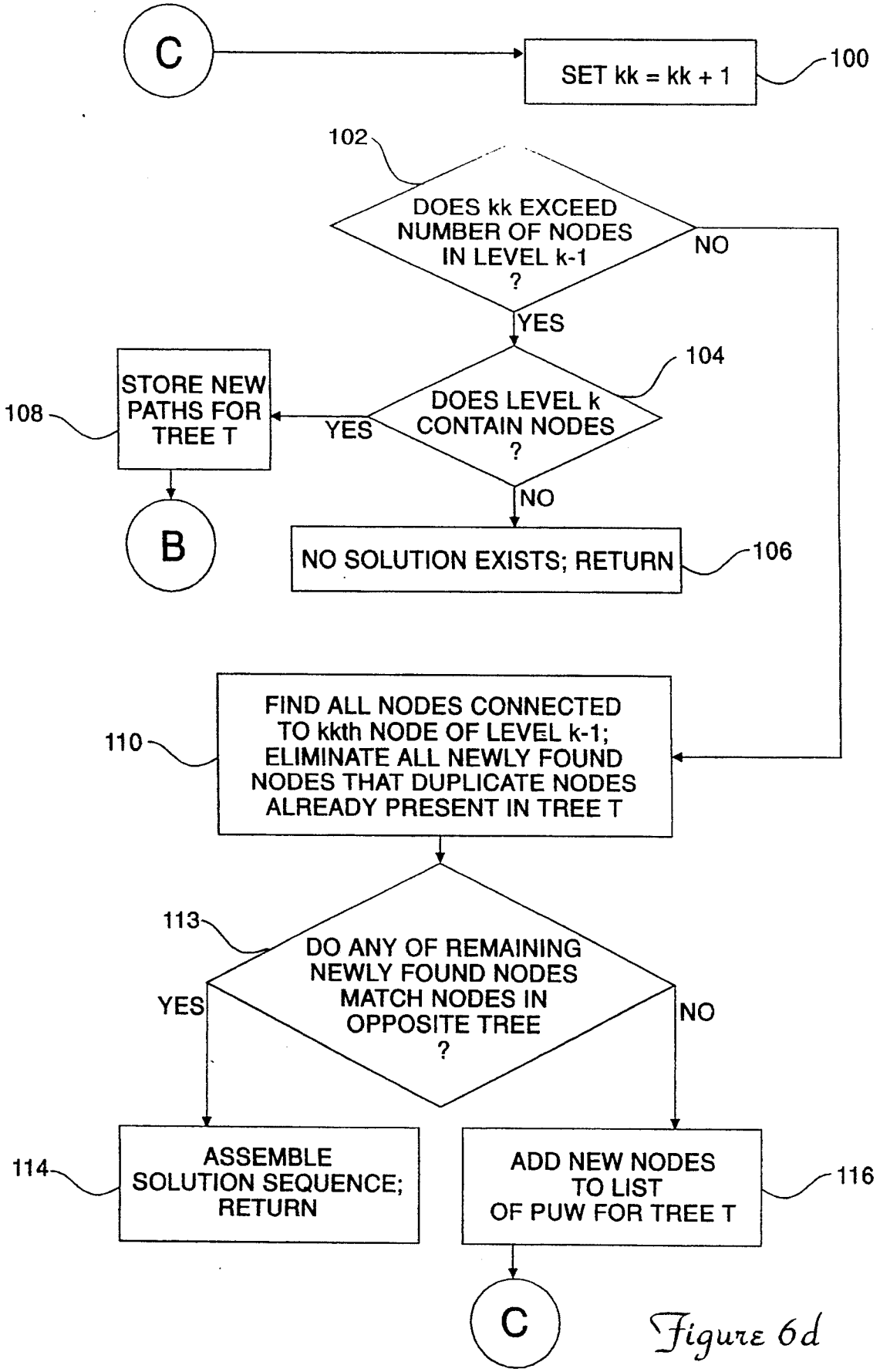

The use of two trees is depicted schematically in FIG. 5. A path 41 in the left tree 42 has been marked with a bold line. Beginning from the root, the nodes of this path 41 are labelled 43, 44, 45, and 46. A partial path 47 in the right tree 48 has also been marked with a bold line. From the root, the nodes of this partial path 47 have been labelled 49, 50 and 51. The ellipses in FIG. 5 represent additional nodes, not shown.

In the situation depicted, the right tree 49 is static while the fourth level of the left tree 42 is being grown. The node 46 has just been added to the left tree 42. The right tree 48 has just been searched for the presence of the word, not shown, that corresponds to the node 46, and it was found on the node 51 of the right tree 48. Thus, if the left tree 42 has been grown from the first terminal word and the right tree 48 from the second, then the solution sequence for the puzzle is the sequence of words that corresponds to the sequence of nodes {43, 44, 45, 46, 50, 49}. Node 51 from the right tree is not written in the sequence because it is a identical to node 46 in the left tree. Note that the partial path 47 originating at the root of the right tree 48 must be reversed (so that its order is downward towards the root 49) to give the correct solution sequence before it is appended to the partial path 41 originating at the root of the left tree 42.

The ability to solve a Doublets puzzle by growing two trees instead of one is very important because, as the trees are grown, all the paths in each tree must be stored; otherwise, at termination, only the length of the optimal solution will have been found, and not the optimal solution itself.

An analysis may be made to quantify approximately the amount of memory required for path storage by use of a two-tree method in comparison to a one-tree method. As new levels are added to a tree (in either method), the number of nodes in the top level of the tree (and therefore the number of paths in the tree) may be estimated to be of the order of a constant raised to the power of the number of levels in the tree, not including the root level. The constant is the typical number of words connected under the Doublets transformation rules to a typical word in the N-letter lexicon. If C is the constant and L is the length (including terminal words) of the optimal solution for a certain puzzle, then by the one-tree Djikstra method, approximately $C^{L-1}$ paths would have to be stored. In the two-tree method, approximately $C^{(L/2)-1}$ paths must be stored in each of two trees, for a total of approximately $2C^{(L/2)-1}$ paths. Comparing this with the $C^{L-1}$ paths stored by the one-tree method, it can be seen that the two-tree method reduces the number of paths which must stored by a factor of the order of $(\frac{1}{2})C^{L/2}$.

The above attempt to quantify the reduction in memory requirements resulting from the use of the two-tree method is heuristic, in that the constant C is but a general approximation to the actual behavior of a tree grown from an arbitrary N-letter word. However, it indicates the reductions that are achievable in the required path storage compared with the one-tree Djikstra method; these reductions can be as large as several orders of magnitude for five-letter puzzles with lengthy optimal solutions. A similar saving is achieved in the number of computation and comparison operations needed to grow a new level on each tree, since the number of these operations is roughly proportional to the number of nodes on the top level of the tree. In spite of the vastness and highly connected character of the graphs of 3-, 4-, and 5-letter English words under the Doublets transformation rules, the combined savings of memory and computation reduce the puzzle solution time periods to acceptable values for humans playing a game using a contemporary personal computer.

Under the two-tree method, as each new (i.e., non-redundant) node is added to a given tree, the opposite tree must be searched for that node, as described in greater detail hereinbelow. The search is a very cheap price to pay for the savings in time and memory achieved by the use of two trees rather than one.

Further savings are achieved by the use of a special method of control over how the two trees are grown. The growth of the two trees is best managed in the following manner: Initially, each root is allowed to sprout one new level. After that, the growth of a new level is always done in the tree containing the smaller number of paths (i.e., the tree with the smaller number of nodes in the topmost level). This results in the smallest possible growth in the number of paths prior to finding a solution or determining that one does not exist, saving further time and memory. Empirically, this method of control over growth of the trees appears to yield an overall improvement that is of the order of 50% in speed and reduction in use of memory as compared to use of a two-tree method in which the trees are grown alternately, without regard to the number of paths they contain.

The schematic diagrams of FIGS. 4 and 5 and the description given above may be translated into a flow chart (FIG. 6) showing the actual sequence of operations which constitute the two-tree method of solution.

The two-tree method of solution is best represented in software as a separate module. The operation of puzzle solution begins as the software module described by the flow chart receives the pair of puzzle words (the terminal nodes) from the routine or module that calls it, step 60. It is assumed in the flow chart that the two puzzle words are not identical and not immediately adjacent nodes in the graph of N-letter words under the Doublets transformation rules.

Intialization of the solution, step 62, occurs with the assignment of the first and second puzzle words, respectively, to the roots of the left and right trees. The left tree is designated here as tree L, and the right tree as tree R. The roots of the left and right trees are each designated as level 1 of their respective trees, and are denoted for purposes of this flow chart as levels 1L and 1R, respectively.

Figure 8:
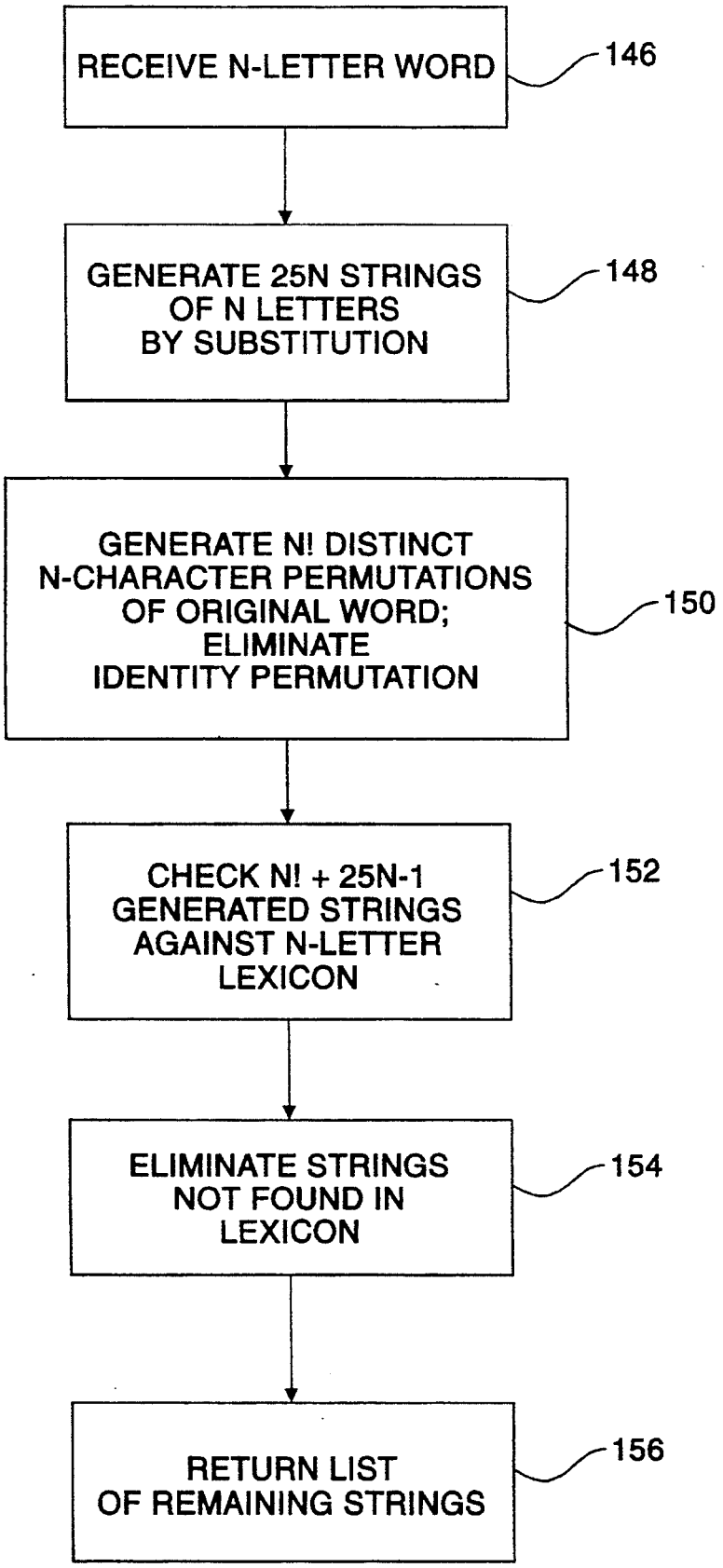
FIG. 8 is a flow chart depicting the method of finding all the words connected under the Doublets transformation rules to a given word.

Next, the processor finds all the nodes connected under the Doublets transformation rules to the root node of the left tree, step 69. The internal sequence of operations for finding all the nodes connected under the Doublets transformation rules to any given node is described in greater detail hereinbelow with reference to the flow chart of FIG. 8. If no nodes can be found that are connected to the root word of the left tree, step 70, then there is no solution to the puzzle. In this case the solution method terminates, step 71, with a finding that no solution exists. Program control is returned to the routine that called the puzzle solution routine. An example of an English word which has no other English words connected to it under the Doublets transformation rules is the word "opera". Thus, the puzzle OPERA HOUSE, for example, has no solution; in this case, step 71 would be executed.

If one or more nodes are found, step 70, then these nodes are designated as level 2L (i.e., the second level of the left tree), step 72.

If a match is found between any node of level 2L and the root of tree R (i.e., the sole node of level 1R), step 73, then a solution has been found and a solution sequence is assembled, step 74. The solution sequence and program control are then returned, step 74, to the routine that called the puzzle solution module. The sequence of operations for checking the opposite tree for matches is discussed below. Some of the sequence of operations necessary for assembly of a solution as in step 74 are depicted in the flow chart of FIG. 13.

If no match is found between any node of level 2L and the root of tree R, step 73, then the nodes of level 2L are inserted into an alphabetical list of previously used words (PUW) for the left tree, and the paths of the left tree are stored, step 76. Whether the paths and the alphabetical list are contained together in one single array or separately in two arrays depends on the method used for storing the two trees in memory. Storage of nodes newly added to the tree is described with reference to FIGS. 9 through 12.

Next, the processor finds all the nodes connected under the Doublets transformation rules to the root node of tree R, step 77. If no nodes are found which are connected to the root node of tree R, step 78, then the puzzle solution routine returns program control to the routine that called it, along with the information that no solution to the puzzle exists, step 79. If one or more nodes are found (the more common case), step 78, then these are designated as level 2R, step 80.

Each node of level 2R is then checked against each node of levels 1L and 2L, step 81. If a match is found, then a solution sequence is assembled, step 82. The solution sequence and program control are then returned to the routine that called the puzzle solution routine, step 82. If no match is found between the nodes of level 2R and those of levels 1L and 2L, step 81, then the nodes of level 2R are inserted into the list of previously used words for the right tree and the new paths are stored, step 86.

At this juncture in program flow each tree consists of two levels. Counters, denoted for purposes of the flow chart as $i_L$ and $i_R$, and indicating the number of levels in the left tree and the right tree respectively, are initialized to the value of 2, step 88. Each counter $i_L$ and $i_R$ is set at step 88 such that, when subsequently incremented, its value will be that of the level in the process of being added.

Next the tree with the fewer nodes in the top level is selected for growth, step 90. If both trees have the same number of nodes in the topmost level, then the tree selected for growth, step 90, is, arbitrarily, the left tree (tree L).

After selection of one of the trees for growth, step 90, certain counters and identifiers are set, step 92. The variable T is an identifier denoting the currently active tree that is set in step 92 to one of two values, namely, L for the left tree, or R for the right tree. The counter for the current working level in the active tree ($i_L$ or $i_R$ for the left or right tree respectively) is incremented by one, step 92. A counter k is set to the value of the level counter ($i_L$ or $i_R$) associated with the active tree T, step 92.

Two methods for the storage of paths in memory, a preferred method and an alternative method, are described hereinbelow with reference to FIGS. 9 through 12. If the alternative method of path storage is used, then the variable k is checked, step 94, to see if it exceeds a parameter $k_{max}$, representing the maximum number of levels allowed in either of the trees under the alternative method of path storage. If the preferred method of path storage is used, then the test performed in step 94 is omitted. If it is found in step 94 that k exceeds $k_{max}$, then the method has failed to determine whether a solution to the puzzle exists, due to inadequacy of the allocated memory. In this case, program control is returned to the calling program, step 96, with the information that the attempt at puzzle solution ended with neither a solution nor a definitive determination that no solution exists. In fact, for three-, four- or five-letter words, k is not likely to exceed 10, $k_{max}$ can be set at 12, and step 96 need never be executed.

Next, a list of the words associated with the nodes of the (k−1)th level of tree T is created, step 97. The manner in which this is done depends on the method used for the storage of nodes and paths in memory, discussed below.

A new counter, denoted in the flow chart as kk, is initialized, step 97. Counter kk tracks the nodes in the (k−1)th level of tree T, contained in the list created in step 97, as these nodes are considered one by one to find the nodes of the kth level.

Next, counter kk is incremented, step 100. If the value of counter kk, after incrementation, exceeds the number of nodes in the (k−1)th level of tree T, step 102, then the growth of the kth level of tree T is complete. In this case, the processor determines whether the kth level of tree T contains any nodes at all, i.e., whether any newly found nodes are connected to any nodes of the (k−1)th level, step 104. If not, step 106, then no solution to the puzzle exists; this information, and program control, are returned to the routine that called the puzzle solution routine. If it is determined that the kth level of tree T contains at least one node, step 104, then the new path or paths for tree T are stored, step 108. Control then transfers back to step 90, in which the determination is made as to which tree has the fewer nodes in the topmost level.

If counter kk does not exceed the number of nodes in the (k−1)th level of tree T, step 102, then all nodes are found which are connected to the kkth node of the (k−1)th level of tree T, step 110.

This is followed by elimination of all of the nodes found in step 110 that already are present in tree T. This is accomplished by comparison of newly found nodes (words) with the list (for tree T) of previously used words. The comparison is most conveniently done using the well-known binary search method, described by L. Kronsjö in *Algorithms: Their Complexity and Efficiency, Second Edition*, John Wiley and Sons, New York, 1987, pp. 286–287. It is to facilitate binary search that the list of previously used words must be maintained in alphabetical order.

The nodes remaining after step 110 are checked seriatim for matches with any nodes in the opposite tree, step 113. This check is most conveniently accomplished by binary search of the alphabetical list of previously used words for the opposite tree. If a match is found, step 113, then a solution sequence is assembled, and the solution sequence and program control are returned to the routine that called the puzzle solution routine, step 114.

Solutions to a shortest-path problem are not necessarily unique; multiple optimal solutions may exist for a given puzzle. For purposes of the game described hereinbelow, it is sufficient to find one optimal solution or to determine that none exists. When two or more optimal solutions exist, which one in particular is found by the inventive method depends on the order in which the nodes remaining after step 110 are checked in step 113 against the nodes of the opposite tree, and on the order in which the nodes of the (k−1)th level of tree T undergo step 110, i.e. the order in which they appear in the list created in step 97. If it is desired, for purposes of a different game requiring the two-tree method of puzzle solution, or for some other purpose, to find multiple optimal solutions of a puzzle, then minor modifications of the inventive method may easily be made by a person skilled in the art.

If no match is found, step 113, then the new nodes (words) found in step 110 are stored in the list of previously used words for tree T, step 116. Control is then transferred back to step 100, in which the counter kk is incremented.

Figure 7A:
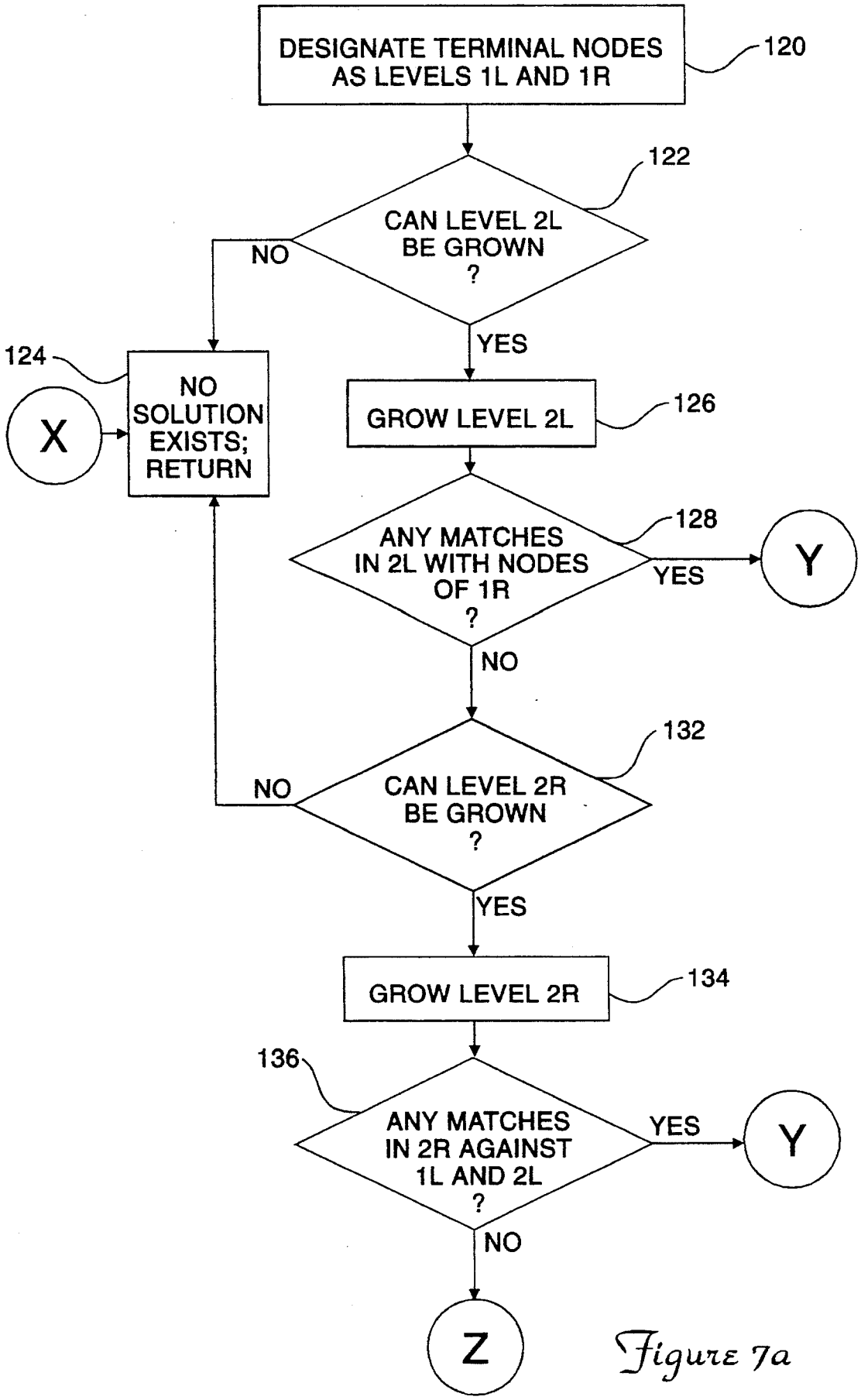
FIGS. 7*a* and 7*b*, taken together to form
Figure 7B:
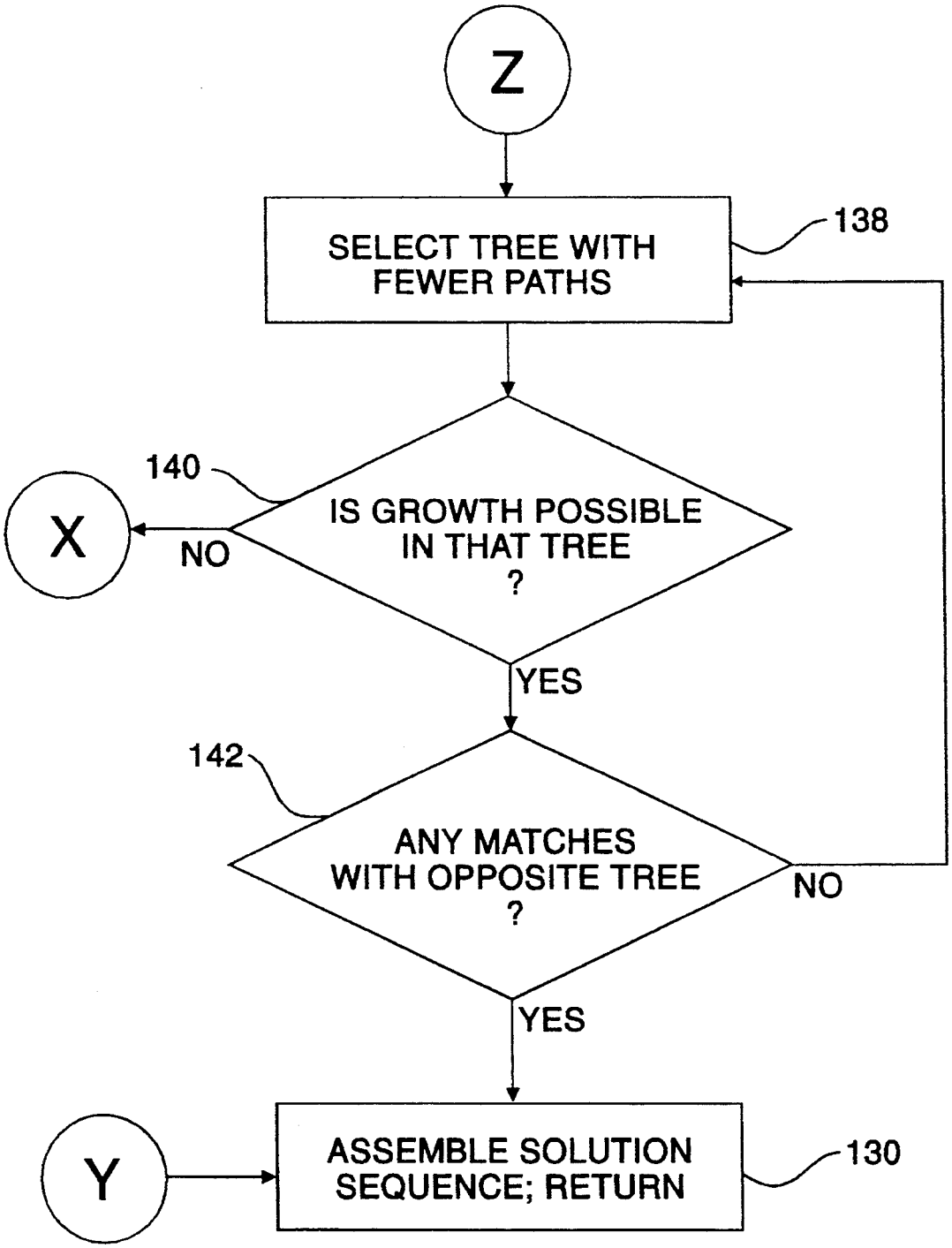

The major steps of the method described in FIG. 6 are summarized in the flow chart shown in FIG. 7.

First, the two terminal nodes are deignated as levels 1L and 1R of two minimum-length trees, step 120. The left (L) tree is grown from the first or source puzzle word; the right (R) tree from the second or destination puzzle word.

Next, an attempt is made to grow level 2L, step 122. If no growth is possible, step 122, then no solution exists; this information is returned, along with program control, to the calling routine, step 124. If growth is possible, step 122, then level 2L is grown, step 126. All level 2L nodes are checked, as they are found, for matches against level 1R, step 128. If a match is found, step 128, the solution sequence is assembled, and the solution and program control are returned to the calling routine, step 130. If no match is found, step 128, then an attempt is made to grow level 2R, step 132. If no growth is possible in level 2R, step 132, then no solution exists; that information and program control are returned to the routine that called the puzzle solution routine, step 124. If growth in level 2R is possible, step 132, then level 2R is grown, step 134. All level 2R nodes are checked as they are found for matches against level 1L and level 2L, step 136. If a match is found, step 136, then the solution sequence is ssembled, and the solution sequence and program control are returned to the calling routine, step 130. If no match is found, step 136, then the tree with fewer paths is selected for growth, step 138. If no growth is possible in the selected tree, step 140, then no solution exists; that information and program control are returned to the calling routine, step 124. If growth is possible in the selected tree, step 140, then all new nodes are checked as they are found for matches against all nodes of the opposite tree, step 142. If no match is found, step 142, then the tree with fewer paths is again selected for growth, step 138. If a match is found, step 142, the solution sequence is assembled, then the solution sequence and program control are returned to the calling routine, step 130.

Applying either the inventive method or Djikstra's method to solving Doublets puzzles requires being able to find all the N-letter words that are connected to a given N-letter word under the Doublets transformation rules. Maintaining a table or matrix containing this information and updating it as deletions from the lexicon occur during play is theoretically possible but not desirable in practice, because of the amount of required memory. When it is necessary during the growth of a new level in a tree to know all the words that are connected to a given word, it is more efficient to recover that information implicitly as needed from the lexicon and the transformation rules than to maintain a table. The method by which this is done is illustrated by the flow chart shown in FIG. 8. The operation depicted in the flow chart is best implemented as a separate module in software.

The sequence of steps begins with module's receipt of an N-letter word from the routine that calls it, namely, the puzzle-solution routine, step 146. The N-letter word received may be referred to as the generator word. Next all the N-letter character strings are found that can be formed by substitution of a single letter into the N-letter generator word, step 148. These are algorithmically trivial to generate and will be 25N in number. Following this, all the possible permutations of the N-letter generator word are found, other than the generator word itself, step 150; these permutations will then be N!−1 in number. Permutations may be found efficiently using the algorithms described by D. Knuth in *The Art of Computer Programming, Volume 1: Fundamental Algorithms* (Addison-Wesley, Menlo Park, 1968, pp. 44–45).

After finding all of the (N!−1)+25N N-letter character strings which can be formed from the N-letter generator word, these character strings are checked against the lexicon, step 152. This may be done efficiently using the binary search method referred to above. Those among the (N!−1)+25N character strings that are actually found in the lexicon are the words connected under the Doublets transformation rules to the word in question; the others are eliminated, step 154. The words that remain after step 154 may be referred to as the generated words.

Program control, and the list of generated words connected to the N-letter generator word, are then returned to the calling routine, step 156. As noted above in the discussion of FIG. 6, the order in which the entries of this list appear influences which optimal solution in particular is found by the inventive method. However, if the object is to find any optimal solution (as in the game described below), it is immaterial in what order the list is composed.

Either of two basic methods may be used for storing the paths of a tree: (1) a method in which each path of each tree is stored explicitly as a sequence of words, and a separate alphabetical list of previously used words is maintained; or (2) a method in which an alphabetical list of previously used words is maintained for each tree; and associated with each element of this list is another element, an integer number denoting the level of the tree previous to the level of the alphabetized word; and further associated with each element in this list is the word in the previous level of the tree from which the above-mentioned alphabetized word (the list element) was generated (or "grown") according to the Doublets transformation rules.

The second of these two methods is the preferred method, the first being an alternative method. However, the alternative method is mentioned and described first because its description furnishes convenient illustrative material for the description of the preferred method.

Figure 9:
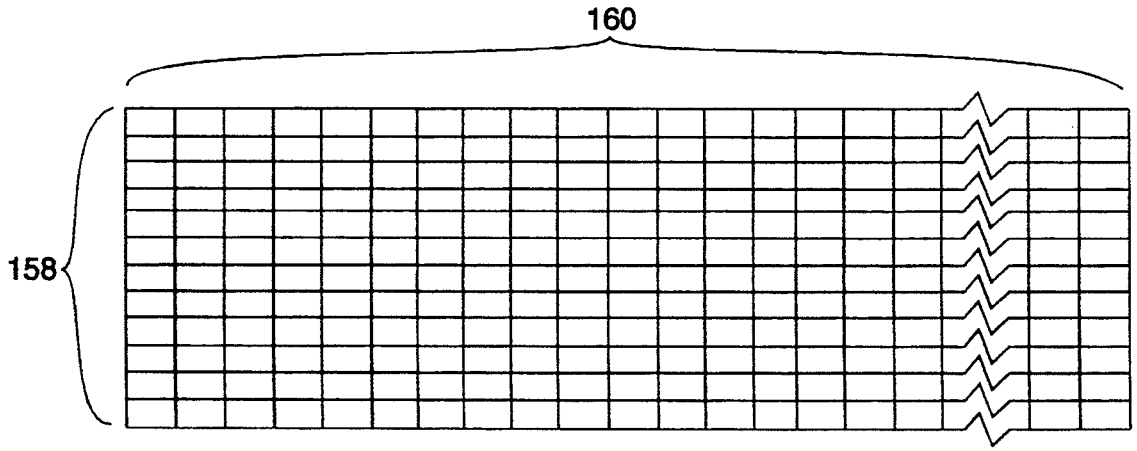
FIG. 9 depicts schematically one method by which the two minimum-length trees are stored in memory.

The memory area reserved in the alternative method for the storage of the paths associated with one tree is diagrammed in FIG. 9, which shows a rectangular array in which each array element represents the amount of memory required to store one N-letter character string. This amount of memory is referred to herein as a "word element". For an N-letter word, a word element may consist of N bytes, corresponding to an ASCII character representation of an N-letter word in memory. Word elements are contiguous areas of the processor's memory, appearing in the diagram of FIG. 9 from the top left down the first column, then right one column to the top of the second column, then down the second column, etc. The vertical dimension of the schematically represented array (the number of word elements in a column, indicated graphically by a brace denoted by the numeral 158) is the maximum number of levels which will be permitted in one tree (the $k_{max}$ value of item 94, FIG. 6). The horizontal dimension of the schematically represented array (indicated graphically by a brace and denoted by reference numeral 160)

is the maximum number of paths which may be stored in one tree.

Each column in the array represents a path within a tree, with the root at the top of the figure; each word element represents one word in a path. Many of the words in any row are necessarily duplicates of each other. In fact, the first row contains many copies of only a single word, the root.

As noted above in the discusion of FIG. 6, the fashion in which the list created in step 97 (i.e., the list of nodes of the (k−1)th level of the active tree T) are considered and processed through step 110 of FIG. 6 depends on the choice of method for the storage of nodes and paths in memory. For the alternative method, the list made in step 97 may be simply constructed by taking the nodes in the order in which they appear from left to right in the bottom-most row that contains non-null entries of the array depicted in FIG. 9.

FIG. 10 illustrates the storage of paths in memory for the first method (the alternative method) as used in the solution of the 4-letter example puzzle WORD GAME. Here, the diagram of FIG. 9 has in effect been rotated 90° counter-clockwise. The letters in the first column 169 of FIG. 10 indicate the tree (left or right) which is represented in that portion of the figure. Their purpose is to clarify the figure; they are not part of the array. Each number in the second column 170 of FIG. 10 refers to a column in FIG. 9. Each four-letter word in FIG. 10 represents the contents of one word element in FIG. 9.

The root word WORD 172 is the first level of the left tree. After the second level 173 has been added to the left tree, the left tree's representation in memory is as shown by reference numeral 174. Ten words 173 (CORD, FORD, LORD, . . . , WORT) have been found which are connected to WORD 172 under the Doublets transformation rules. None of these matches the root word GAME 176 of the righthand tree, so no solution has been found on the first iteration of the method.

After a second level has been added to the righthand tree, the tree's representation in memory is indicated in FIG. 10 by reference numeral 178. In the growth of level 2 of the righthand tree, 16 words 180 have been found that are connected to the word GAME under the Doublets transformation rules. These are CAME, DAME, FAME, . . . , MAGE. None of these words 180 matches the words 172 in level 1 or the words 173 in level 2 of the lefthand tree 174.

Of the two trees, the lefthand tree 174 now contains the smaller number of paths (namely, 10 versus 16 for the righthand tree 178). Thus, the lefthand tree 174 is the next one to be grown. (In this example, choosing for growth at each iteration the tree with fewer paths results in alternation between the trees. This will not necessarily or generally occur.) Referring to FIG. 10, the result of the growth of level 3 of the lefthand tree is shown 182. The lefthand tree 182 now contains a total of 69 paths. Connected under the Doublets transformation rules to the word CORD in level 2 of the lefthand tree are eight words 184, namely, CARD, COED, COLD, . . . , CURD. The root word WORD is also connected to CORD under the Doublets transformation rules, but is not added to level 3 because it is already present in the tree in level 1. Similarly, another 61 words 186 have been found which are connected under the Doublets transformation rules to the remaining nine distinct words of level 2 in the lefthand tree. None of these words 184 and 186 matches the words in level 1 or level 2 of the righthand tree 178.

The righthand tree 178 is now the tree containing the smaller number of paths (16 versus 69 for the lefthand tree 182). Thus, the righthand tree 178 is selected for growth and, after the growth of its third level, is shown in FIG. 10 as reference numeral 188. It now contains 124 paths. The first word of the second level, CAME, has yielded 13 new words 192 connected to it under the Doublets transformation rules, namely, CAFE, CAGE, CAKE, . . . , COME, MACE, ACME. Similarly, the remaining 15 distinct words of level 2 of the righthand tree collectively yielded 111 new words 194.

As the lefthand tree 182 is now the tree with the fewer paths (69 versus 124 for the righthand tree 188), it is the lefthand tree 182 which is selected for the next growth of a new level. It is not necessary explicitly to carry this example further to show how the paths are represented in memory in the alternative method. However, it can be seen by inspection of FIG. 10 that the very first path 195 (WORD, CORD, CARD) in the lefthand tree 182 will yield the word CARE among the early additions to level 4, and that this will match the word CARE 196 in level 3, path number 8, of the righthand tree 188. Thus, it is evident that a solution will be found on the very next iteration.

The list of previously used words is maintained in a separate array from that diagrammed in FIG. 9.

A simple improvement may be made in the method described above (the alternative method). The improvement is not to keep multiple copies of the root words in the memory area that is assigned to trees, but to keep only a single copy of each root word in some other location in memory. Less memory is used by not explicitly keeping multiple copies of the root in memory.

A further improvement in the above basic method (the alternative method) may be made. In the method described above, nodes (N-letter words) in paths are stored as ASCII character strings, word elements of N bytes. Thus, for five-letter puzzles, five bytes are required for each word element. Less memory is required to store each word element if a pointer to a location in the lexicon is used instead of an ASCII character string. Since a fairly comprehensive five-letter English lexicon numbers somewhat less than 7000 words, a two-byte pointer is adequate (the minimum requirement is 13 bits).

If the word elements of FIG. 9 are stored as ASCII character strings, the programmer may choose between marking deleted lexicon elements and actually removing them. However, if the word elements are pointers to words in the lexicon, then actual removal of deletions from the lexicon results in the pointers in the path-storage trees no longer pointing to the correct lexicon elements. Thus if pointers are used instead of ASCII character strings, lexicon elements must be marked as deleted but not actually removed.

Figure 11:
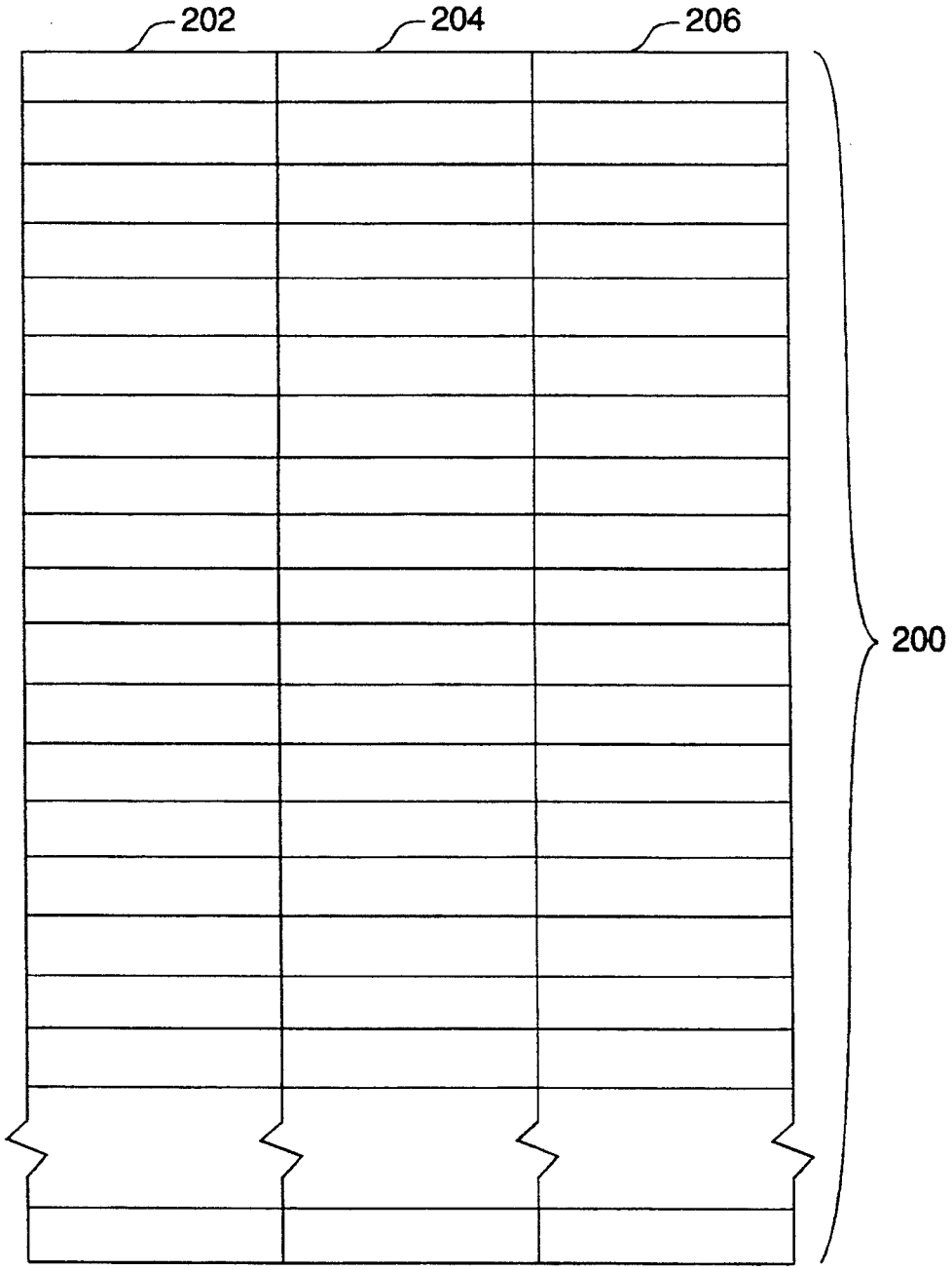
FIG. 11 is a schematic diagram depicting a second method by which the two minimum-length trees are stored in memory.

The second basic method (the preferred method) of storage of paths is quite different from the first (alternative) method. The preferred method combines the list of previously used words together with the path storage. The schematic diagram of FIG. 11 depicts an area of memory reserved for the path storage of one tree using the preferred method. Two such areas are required, one for each tree. FIG. 11 represents a "structure", a type of array that may be created in the C programming language, for example, in which it is not required that all elements be of the same data type. (The storage principle to be described here may also be carried out in languages, such as standard Fortran-77, that do not offer the structure-type array, as described below. The structure-type array is convenient but not essential.) If a structure-type array is used, the contiguous areas of memory are represented in FIG. 11 as running from left to right across the first row, then across the second row, etc., as text in English is read in a book. The number of rows allocated, indicated by a brace 200, is the maximum number of words that might ever be expected to appear in a tree. (Tests of randomly selected five-letter puzzles suggest that the maximum number of words that would ever appear in a tree before a puzzle solution is found or it is determined that no solution exists is somewhat less than 700.)

The first column 202 in the array diagrammed in FIG. 11 is the alphabetical list of previously used words for that tree. Each element of the first column 202 may be stored as an ASCII character string (N bytes for an N-letter word) or as a pointer to an element in the lexicon, as discussed above with reference to the alternative method; pointers would use less memory. Each element of the second column 204 is an integer that corresponds to an element of the first column 202. The integer value in the second column represents the level of the tree preceding the level in which the word stored in the first column appears. Since, as discussed above, for five-letter words it is highly unlikely that trees that exceed 10 levels would ever be required, it is not necessary that this integer be assigned more than four bits. Each element of the third column 206 contains an N-letter word which is the generator of the corresponding word 202 in the first column. Thus, the integer in the second column denotes the level of the tree in which the word of the third column appears. By the generator of a word A is meant the word B on the level immediately preceding the level of A, from which the word A was generated under the Doublets tranformation rules. The elements in the third column, like those in the first, may be N-byte ASCII character strings or, preferably, pointers to locations in the lexicon.

As discussed with reference to FIG. 6 above, the fashion in which nodes are considered and processed through step 110 ff. depends on the choice of method for storage of nodes and paths in memory. The list of the nodes of level $k-1$ created in step 97 may be made by passing sequentially down the first column 202 of FIG. 11, and selecting all nodes for which the entry in the second column 204 is equal to $k-2$.

If the game is to be programmed in a language, such as standard Fortran-77, which does not permit the "structure"-type array, a simple variation on the preferred method may be used. In this variation a separate array may be defined for each column in FIG. 11. In this case the contiguous areas of memory are the columns.

The example puzzle WORD GAME is used again in FIG. 12 to illustrate the preferred method of storage of paths in memory, in combination with storage of the alphabetical list of previously used words. The first column 210 is not part of the information stored in memory using the preferred method, but is included in the figure to indicate clearly to which tree (left or right) the corresponding line in the figure belongs. The second column 212 corresponds to the first column 202 in FIG. 11, and contains the alphabetical list of previously used words for the tree in question. The third column 214 corresponds to the second column 204 in FIG. 11, and contains the number of the level in which the generator of the corresponding word in the second column 212 is found. The fourth column 216 contains the word which is the generator of the word in the second column 212.

The example in FIG. 12 begins at the same stage in the solution of the puzzle WORD GAME at which FIG. 10 is begun. The representation 174 of the left tree in FIG. 10 corresponds to the representation 218 of the left tree in FIG. 12. Here all of the words 220 (CORD, FORD, LORD, . . . , WORT) that are present as nodes in the left tree after the addition of the second level are held in memory in alphabetical order, to facilitate binary search. All but one of these words 220 are level 2 words; thus, the third column 214 carries the value 1 for each, to denote that they are derived from the root. The exception is the root itself (WORD), which carries the value of 0 in the third column 214 to denote that it has no generator, and it carries no information in the fourth column 216.

As in FIG. 10, none of the words 220 in FIG. 12 matches the root of the right tree (GAME), so the the right tree is grown from its root. The result of the addition of the second level to the right tree is denoted in FIG. 12 by numeral 222. Here, all of the words 224 of the right tree 222 are kept in alphabetical order to facilitate binary search. All but one of the words 224 have associated with them in the third column 214 the value 1 to indicate that they are descended from the root word GAME. GAME itself 226 is attended by the value 0 (228) because it has no ancestor, and no information is stored in the fourth column 216 for GAME.

After the addition of the third level to the left tree, the representation of the left tree in memory is as denoted by numeral 230. The first six words 232 of the alphabetical list of words in the left tree (BARD, BORE, BORN, CARE, COED, and COLD) are all descended from level 2 words, as can be seen from the entries denoted 234; their level 2 generators are, respectively, the words 236 WARD, WORE, WORN, CORD, CORD, and CORD. Note that three of the words 232 (CARD, COED, and COLD) are all generated by the same level 2 word, CORD. CORD itself 238 appears next in the list 240, being generated by the root word, WORD. Again, WORD itself 242 appears with a 0 in the third column 214.

Reconstructing the partial path from any member of the tree to the root of the tree is easily done. For example, consider finding the path from the word CARE 244 in the right tree to the root. This will be necessary when, as noted in the discussion of FIG. 10, the word CARE 244 appears in the fourth level (not shown in FIG. 10) of the left tree and then is found in the third level of the right tree. At that juncture the partial path from CARE to the root of the right tree will be needed to compose the latter part of the solution sequence. When CARE 244 is found in the right tree, it is also noted from the information in the same line of FIG. 12 that CARE is generated from the level 2 word, CAME 246. Binary search is then used to locate CAME elsewhere in the alphabetical list, namely, at location 248. There, it is indicated that CAME 248 is descended from the root word GAME 250. Thus, the path in the right tree from CARE to the root GAME has been recovered as CARE, CAME, GAME. The first part of the solution sequence for WORD GAME is recovered in a similar fashion, beginning with the word CARE, from the fourth level (not shown) of the left tree.

The preferred method of path storage requires significantly less memory than the alternative method of path storage when trees attain four levels or more.

Figure 13:
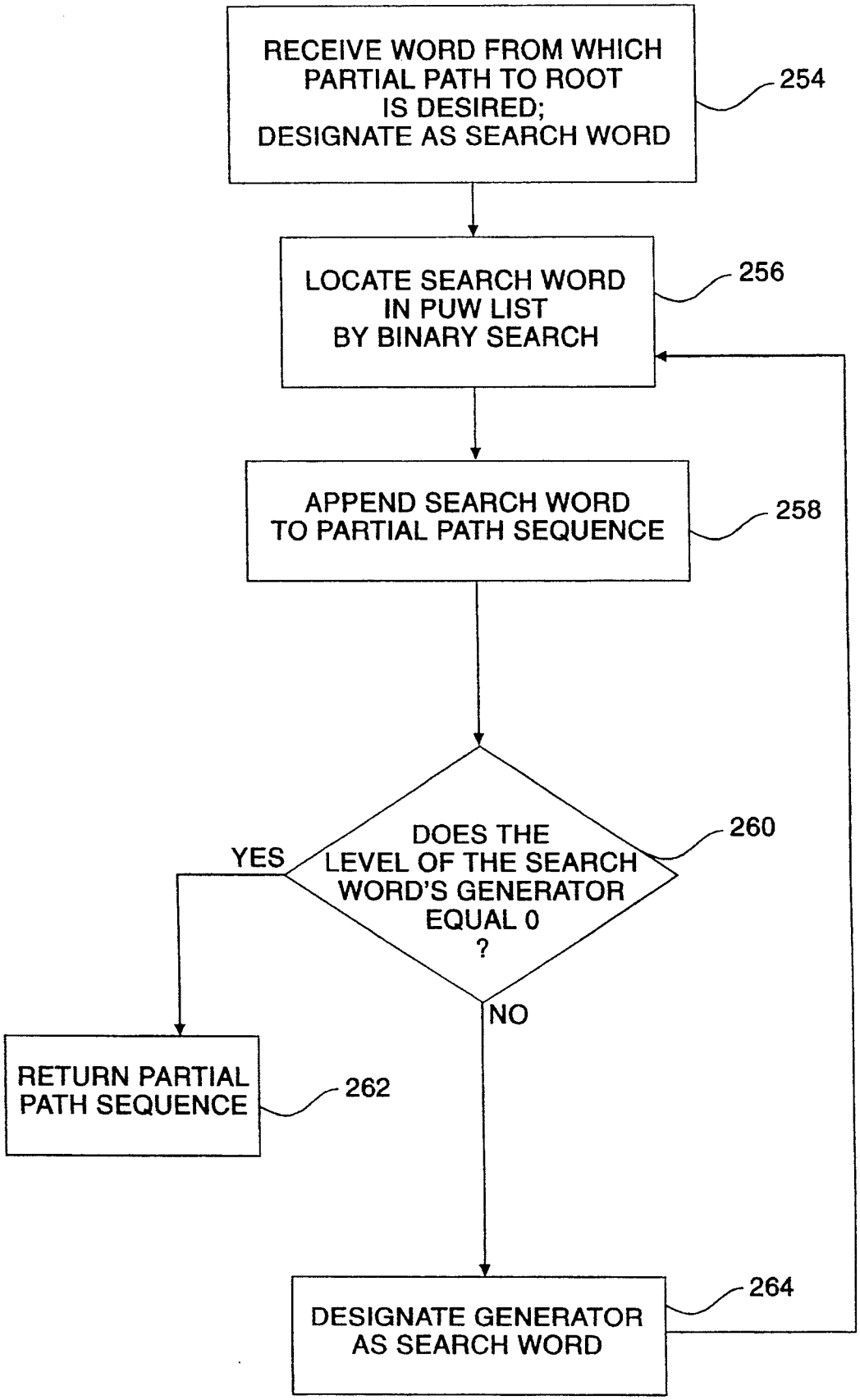
FIG. 13 is a flow chart depicting the manner in which a partial solution sequence is recovered from a minimum-length tree.
Figure 14A:
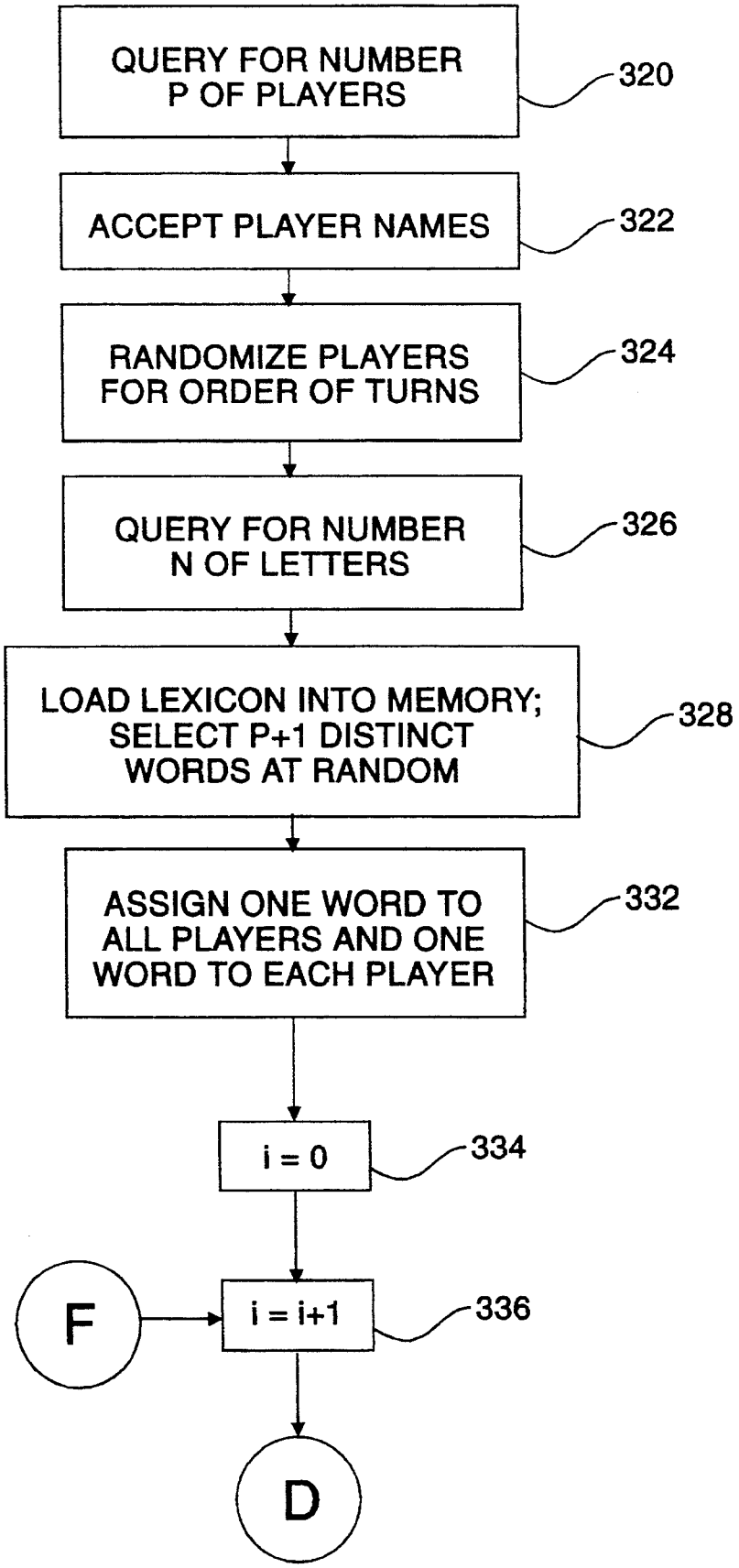
FIGS. 14*a*–14*g*, taken together to form
Figure 14B:
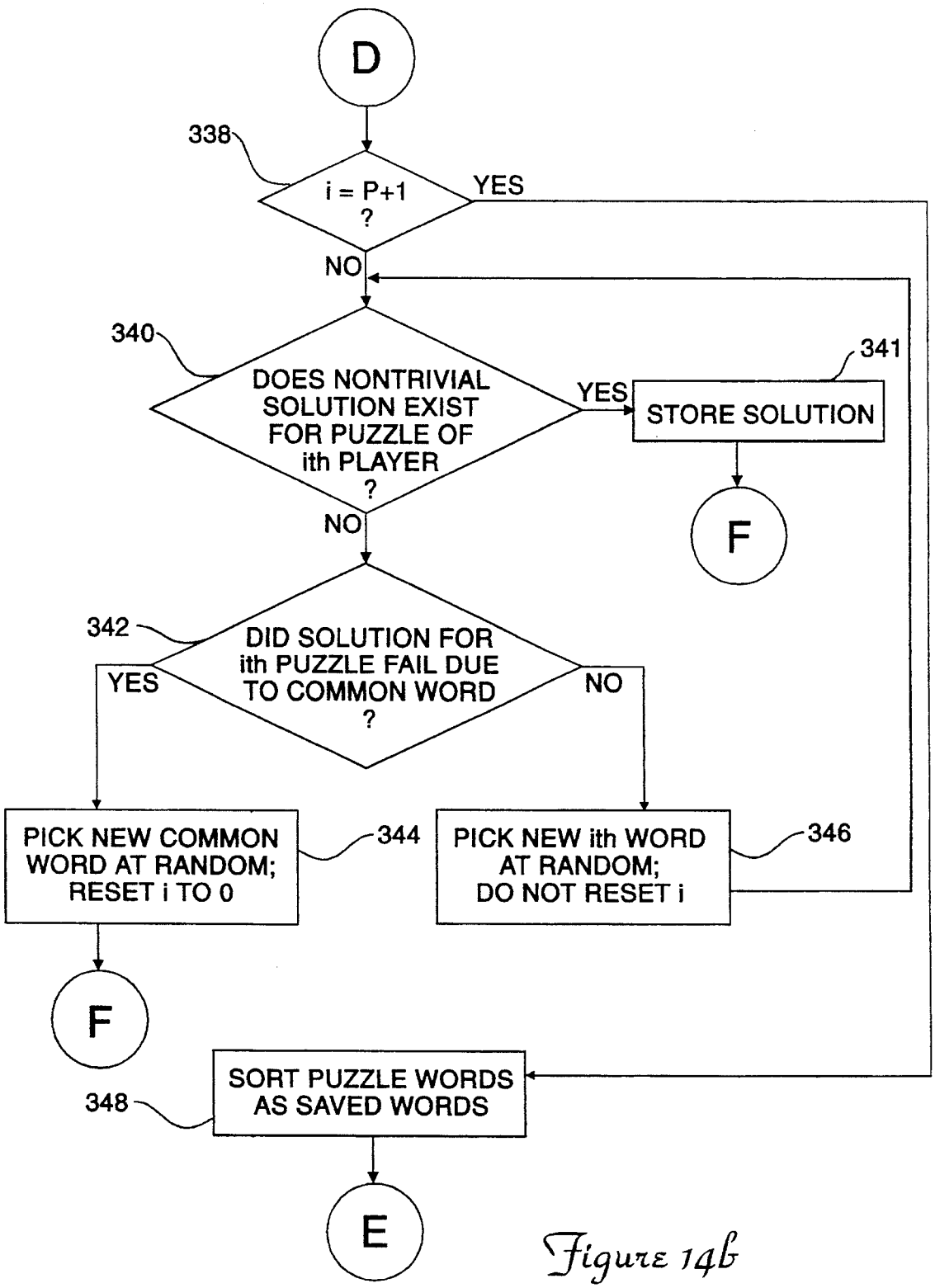
Figure 14C:
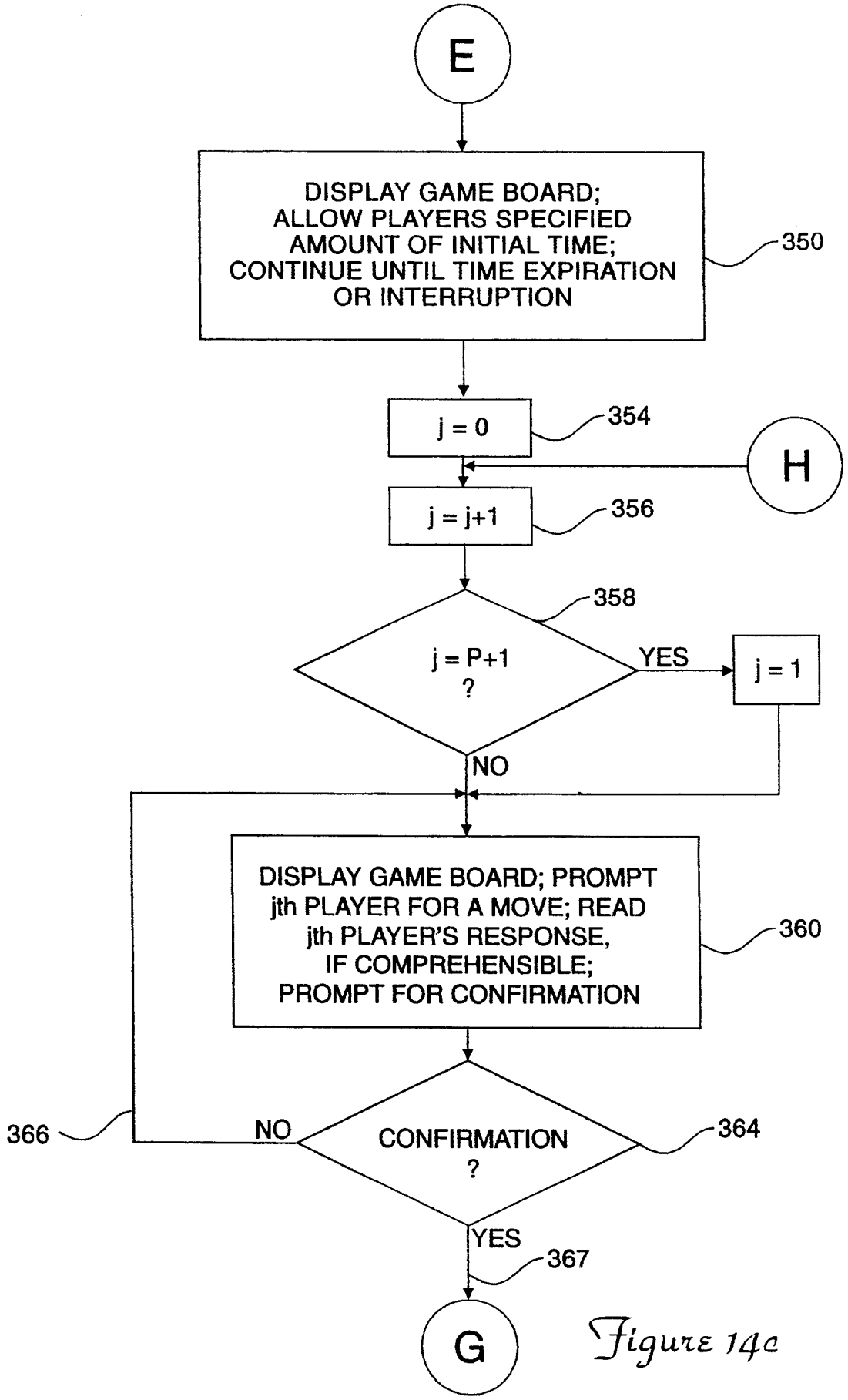
Figure 14D:
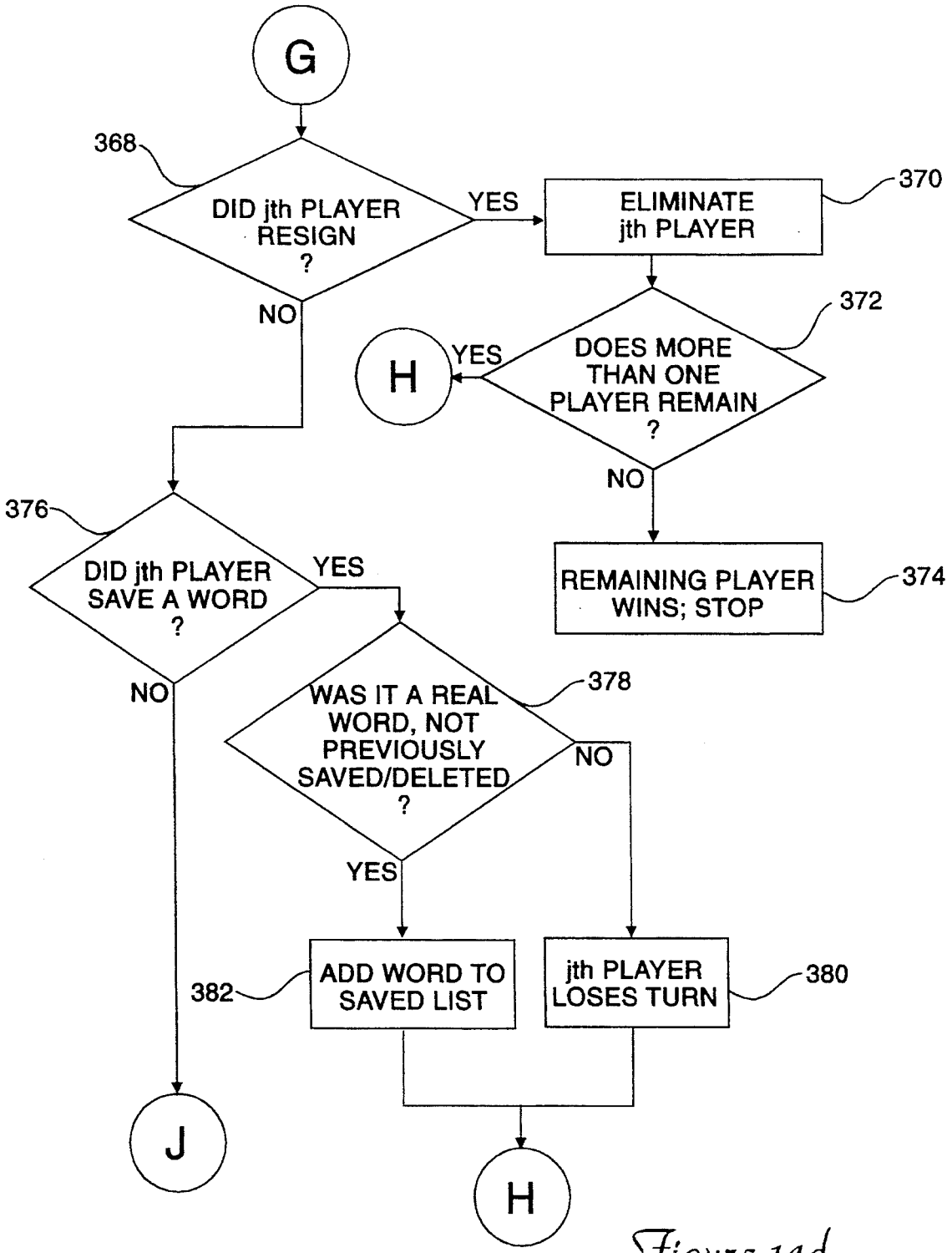
Figure 14E:
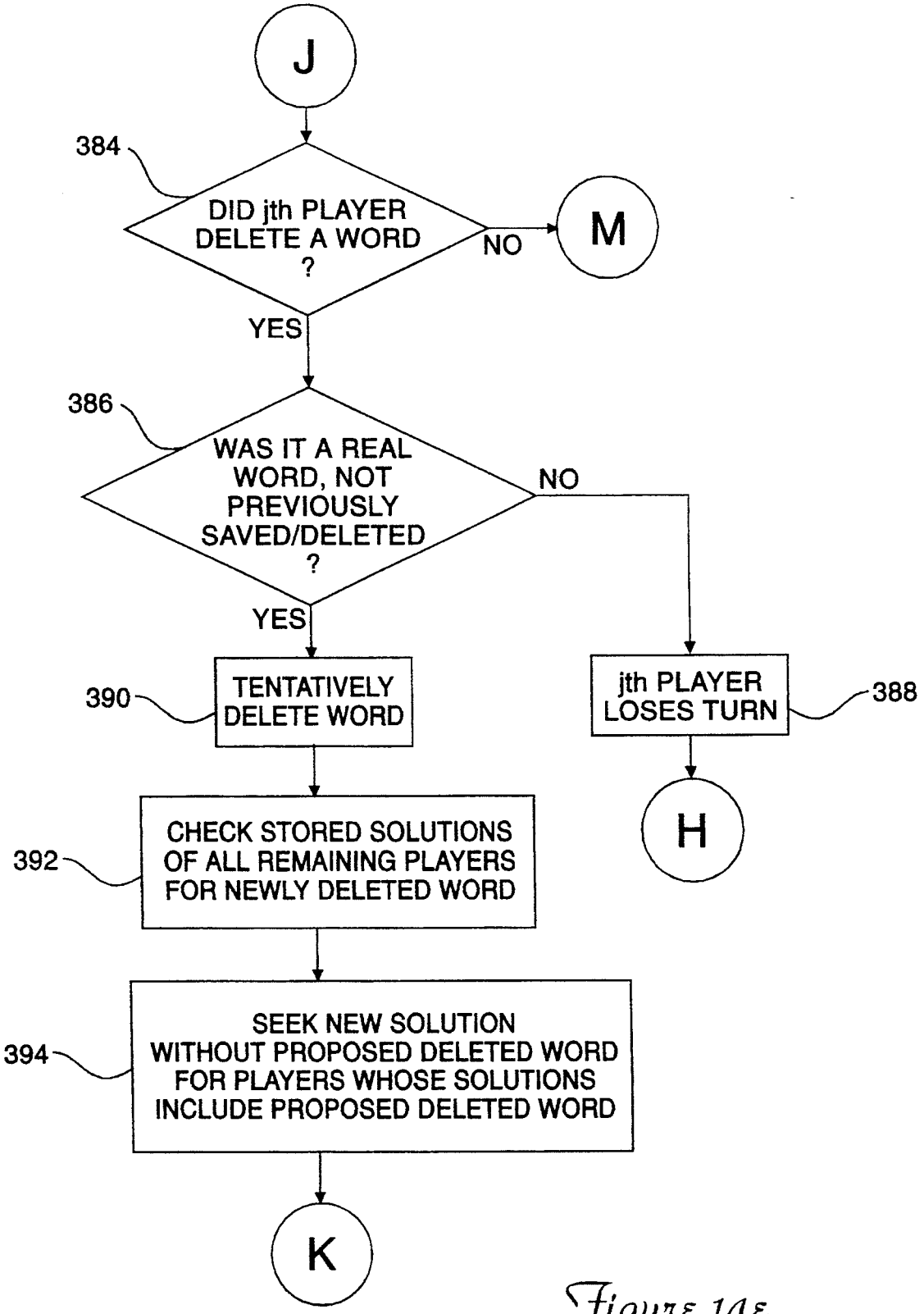
Figure 14F:
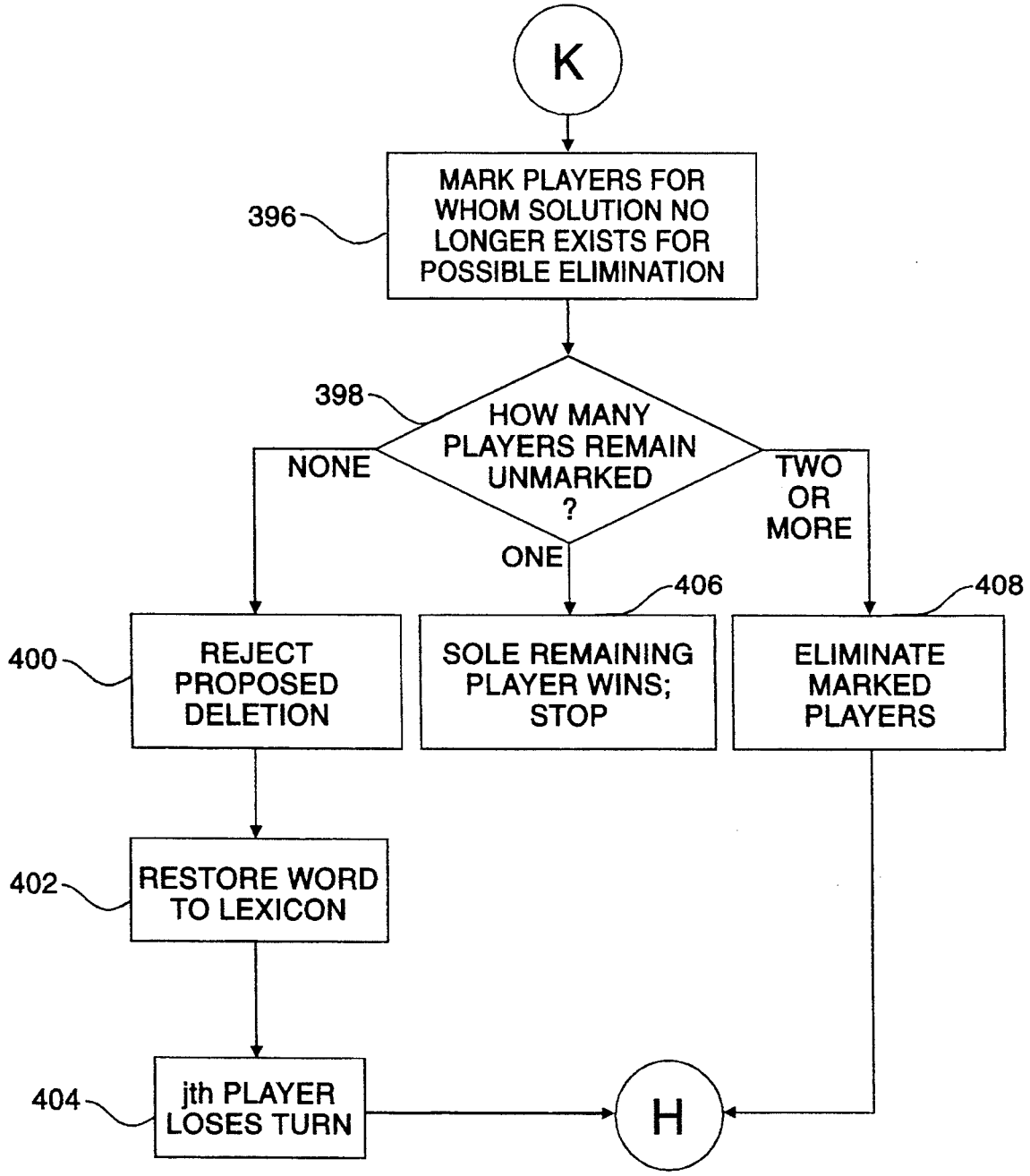
Figure 14G:
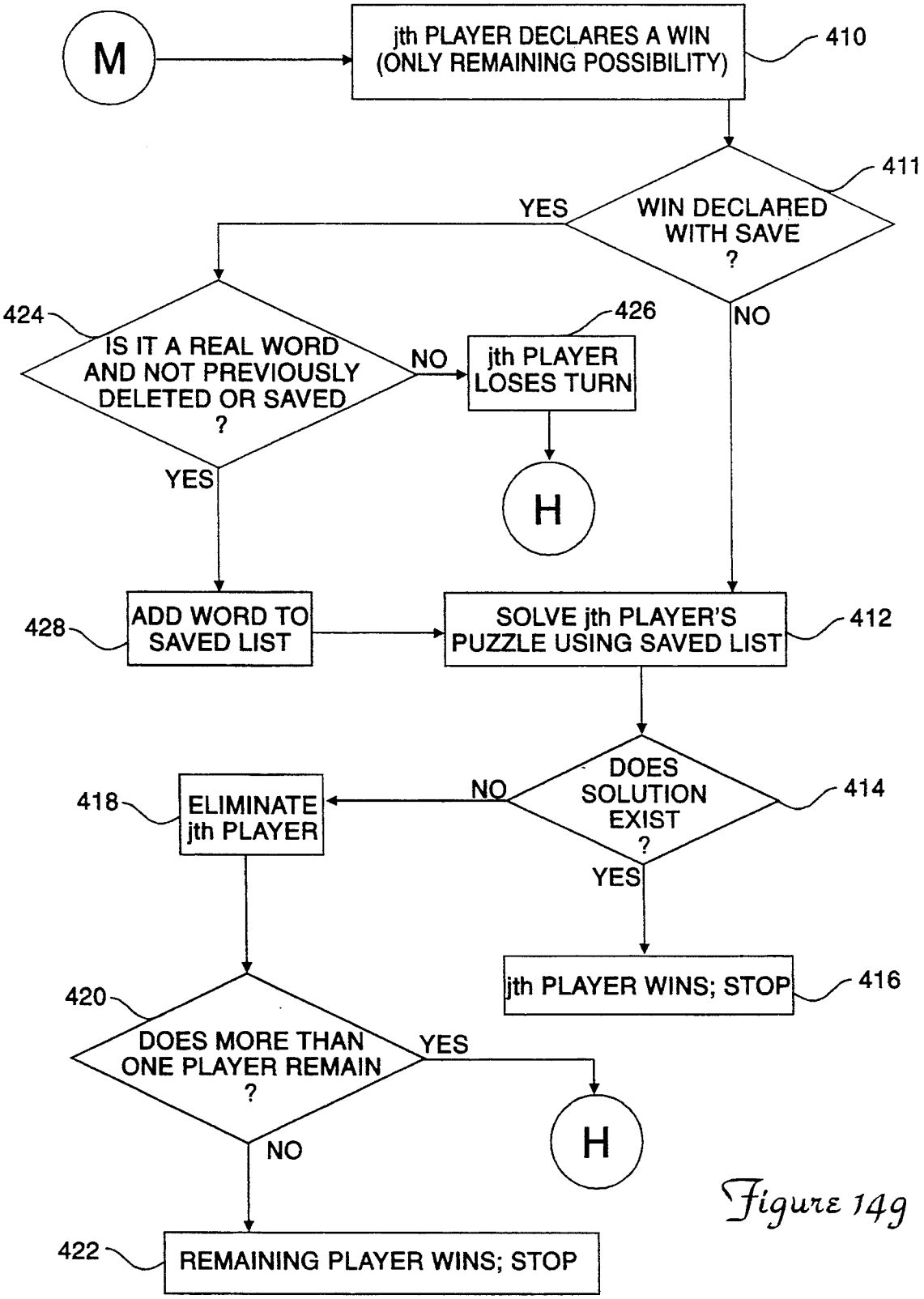

The method of recovering a partial path sequence from the tree stored in memory using the preferred method is diagrammed in FIG. 13, implemented in a separate module of the software.

First the partial-path-recovery module receives from the calling routine the word starting at which the partial path is to be recovered, step 254. Next, the starting word becomes the search word, and is located using binary search in the alphabetical list of previously used words for the appropriate tree, step 256. Then 258 the word is appended to the partly recovered sequence, step 258. (On the first arrival at step 258, "append" means placing the word first in the partly recovered sequence.)

After placement of the search word into the partly recovered sequence, the system determines whether the "level" of the search word's generator is zero, i.e., whether the search word is the root, step 260. If the search word is indeed the root, step 260, then the recovered partial path sequence, and program control, are returned to the calling routine, step 262. If the search word is not the root, step 260, then the generator becomes the search word, step 264. Control then transfers back to step 256, in which the search word is located in the alphabetical list by binary search. Iteration continues until the "yes" path exiting from step 260 is taken.

Asembly of a solution from the two recovered partial path sequences is simple. The first part of the solution is the recovered partial path sequence from the root of the left tree to the node in common among the two trees. For the example puzzle WORD GAME, used above, the first part of the solution sequence is WORD, CORD, CARD, CARE. Next, the partial path sequence recovered from the right tree is reversed. The partial path sequence recovered from the right tree GAME, CAME, CARE is reversed to CARE, CAME, GAME. Next, the redundant appearance of the common word CARE is eliminated, and two partial sequences are joined. Thus, the solution to WORD GAME is WORD, CORD, CARD, CARE, CAME, GAME.

Although Doublets is the best-known type of sequential word transformation puzzle, it should be understood that the scope of the inventive method is not limited to Doublets. Any type of word transformation puzzle in which one word is transformed into another through a sequence of intermediate words according to some predetermined relationship may be solved optimally using the inventive method. All that is required is that all permissible and impermissible transformations be known, either implicitly, such as through a set of transformation rules and a lexicon of acceptable words, or explicitly, as a list, table or matrix of acceptable transformations.

The general conduct of the game by the computer is described hereinbelow with reference to FIG. 14. However, the process may be most clearly understood if the rules of the game are given explicitly here. The rules of the game are:

1. In response to queries from the computer, two or more players P agree on a word-length N and enter their names into the computer. The computer randomly assigns an order of play.

2. From a list of all N-letter words (the "lexicon"), the computer selects at random P+1 N-letter words. Acceptable words are all words that are not abbreviations, proper nouns, hyphenated, or contractions. Word i (i=1, . . . , P) is assigned to player i as one of his two puzzle words. Word P+1 is assigned in common to all players as their other puzzle word. Computer verifies that solutions exist for all puzzle pairs, selecting new puzzle words and verifying new puzzle pairs if necessary. Once selection is complete, computer displays the "game board" (see FIGS. 15 and 16, below). One element of the game board is a display of all puzzle words and the name of the player associated with each.

3. Players are given a specified amount of time to devise solutions to their own and their opponents' puzzles before turns begin. (This amount of time may be agreed on by the players in response to a query from the computer; or a standard time or times may be permanently set in the embodiment of the game.) When this time expires players begin taking turns. At each turn a player must "save" a word, "delete" a word, declare a "win", declare a "save and win", or "resign". The player whose turn it is will be referred to here as the "acting player".

4. If the acting player opts to delete a word, then the following occurs: First, the computer tentatively removes the deleted word from the lexicon. Then, the computer determines whether, under the now-reduced lexicon, a solution exists for the puzzle of each player, including the acting player. Any player, including the acting player, for whom a solution no longer exists under the reduced lexicon, may be identified by the computer and eliminated from the game if the proposed deletion is allowed to stand. If after a proposed deletion only one player would remain in the game, that player is the winner. If two or more players would remain in the game after a proposed deletion, the deletion stands and play continues. If the computer finds that the deletion proposed by the acting player would cause all players to be eliminated, then the computer disallows that deletion and restores the word to the lexicon. In this case the acting player forfeits his turn.

After a proposed deletion becomes effective the deleted word is posted on the updated display.

If the acting player proposes for deletion a word which is not in the lexicon at the time of his turn, or which has already been saved (see next rule), he forfeits that turn.

5. If the acting player opts to "save" a word, and the proposed save stands, then that word is protected from deletion for the rest of the game. After a word is saved it is posted as such on the updated game board. (All P+1 puzzle words are considered as saved words from the beginning of the game.)

If the acting player proposes a word to be saved which is not in the lexicon at the time of his turn, or which has already been saved, then his turn is forfeited, and the proposed save does not become effective.

6. An acting player may declare a "win". This is a declaration by the acting player that he believes that he is able to construct a solution to his puzzle entirely from words that are saved. He may do this in one of two ways.

If he believes that there are already sufficient saved words with which to construct a solution to his puzzle, he may simply declare "win". If his claim is correct, then he is indeed the winner. If his claim is incorrect, then he is eliminated.

If the acting player believes that he needs one more word, in addition to the saved words, to complete his puzzle, he may declare a "save and win", specifying a word to be saved. The computer first scrutinizes the "save" for validity as it would with any other save. If the save is invalid as described above, the acting player forfeits his turn and his "win" declaration is irrelevant. If the "save" is valid, the computer will verify the acting player's claim that a solution to his puzzle can be constructed entirely from saved words, just as it would do for a simple "win" declaration.

If the acting player's "win" claim is disallowed but his saved word is a valid one, then the acting player is eliminated but the save stands and becomes effective.

7. On each turn, the computer will prompt for verification after a word is entered to be saved or deleted. If the acting player confirms an incorrect spelling for a saved or deleted word, it has the same effect as that of a word which is absent from the lexicon at the time of the player's turn, namely, forfeiture of the turn.

FIG. 14 is a flow chart that describes the expression in software of the rules of the game. This routine may be created either as a separate module or may be incorporated directly into the main program.

The first step 320 in the game is to enter the number of players (designated here as P), then to read the player names as they are entered, step 322, by means of the keyboard or other input device. Next the names of players are placed into a random sequence to form the order of play, step 324. The random sequence is derived by using any one of the many published algorithms for generation of pseudorandom numbers from a seed value selected in an appropriate fashion (e.g., by using a numerical representation of the date or time as a seed).

After initialization with regard to number and names of players and order of play, steps 320 through 324, players enter the number N of letters in the puzzle words to be used in the game, step 326. N may be 3, 4 or 5, which correspond to beginner, intermediate and expert-level games. (Puzzle words with more than five letters may, in principle, be used. However, the lexicons of English words containing six or more letters are very poorly connected under the Doublets transformation rules. Thus, they are not very useful in a game of this kind.)

The N-letter lexicon is described in the flow chart as being loaded into memory, step 328. If the game is physically embodied as a program designed to run on a general-purpose computer (as in FIG. 1) or on a general-duty game processor (as in FIG. 2), then the lexicon may be copied from a diskette, cartridge or other replaceable medium into the processor's random access memory. If the device embodying the game is manufactured especially for the purpose as a stand-alone unit (as in FIG. 3), then a permanent copy of the lexicon must reside in a read only memory, while a copy of the lexicon, which may be modified as the game progresses, may be copied into the random access memory.

The lexicon may be stored in the random access memory in any number of ways. The simplest, and preferred, storage method, is alphabetical. Such an array may be searched very rapidly by binary search. Other methods may be used, but as all words have equal probability to be used (unlike in speech or writing), no advantage is gained by storage of the lexicon in a hierarchical form.

The computer then makes an initial selection of puzzles, step 328, by selecting P+1 distinct N-letter words at random from the lexicon. One of these words is then designated as the common word and one each of the remaining words is assigned to each player, step 332.

It must now be verified that the puzzles that have been thus randomly selected in fact have solutions. The process of puzzle verification begins at step 334 with the initialization of a counter i for the number of randomly selected puzzles that have been verified as having a solution. Counter i is incremented, step 336, then its value is compared with that of P+1, step 338. If the value of counter i is less than P+1, step 338, the existence of a solution for the ith puzzle is determined by calling the routine that embodies the two-tree method of solution of Doublets puzzles, step 340. If it is found that a solution indeed does exist for the ith puzzle, step 340, then the solution to the ith puzzle is stored, step 341, and control transfers back to step 336, in which the counter i is incremented. However, if a solution exists but the solution is trivial, then the "no" branch, step 342, is taken coming out of step 340, as if there were no solution. A trivial solution is defined here as one which consists of only two words, namely, the terminal words (source and destination) themselves. This occurs when one terminal word can be made directly (in one step) from the other under the Doublets transformation rules.

Determining that a solution does not exist for the ith puzzle, step 340, indicates that one of the two puzzle words was at the root of a tree that could be grown no further. The information returned by the puzzle-solution routine is examined to determine if the tree that could be grown no further was that having the common word at its root, or that having the ith puzzle word at its root, step 342. If the tree that could be grown no further was that rooted in the common word, step 342, a new common word is selected at random from the lexicon and the counter i is reset, step 344; control is transferred back to step 336 and the verification process begins again. If the tree that could be grown no further was that rooted in the ith word, step 342, then a new ith word is selected at random from the lexicon, step 346. The counter i is not reset, and control next transfers back to step 340, in which the puzzle-solution routine is again called to verify the ith puzzle, now containing a new ith word.

The reason for the decision associated with step 342 is that if the common word is poorly connected under the Doublets transformation rules with the rest of the graph of the lexicon of N-letter words, it will be difficult or impossible to find puzzles for all players that have solutions. In attempting to do so the processor may enter a lengthy or infinite loop; it is preferable simply to replace the common word, step 344, than to wait to determine if this will happen. On the other hand, if it is the tree grown from the ith word, and not that grown from the common word, that can be grown no further during verification of the puzzles, step 342, then it is faster simply to replace that one word (the ith puzzle word) and to continue the verification at that same value of counter i, rather than to replace the common word and unnecessarily restart the verification process.

When counter i is equal to P+1, then all P puzzles have been verified as having solutions, step 338.

Once verification of the existence of puzzle solutions is complete, the puzzle words are sorted alphabetically to initialize the list of saved words, step 348. Then the game board is displayed, step 350.

After the initial display of the game board, step 350, players are allowed a specified amount of time to study their own and their opponents' puzzles and to plan their strategies before they must make any move. The initial display of the game board includes a message to this effect. Fixed choices for the amount of time that players are initially allowed may be set, depending on the value of N, the number of letters in each puzzle word. Alternatively, the players may be permitted to select some other time interval if they so desire. If the players are in mutual agreement to end the initial time before expiration, they may do so.

At the expiration of the initial time period, moves begin. A counter j that keeps track of the identity of the acting player is initialized to zero, step 354, and subsequently incremented, step 356. Next, the value of counter j is reset to j modulo P, step 358. Thus, the value of counter j cycles from 1 through P then back to 1 as the game progresses and the players take their turns in order.

After incrementation and modular arithmetic adjustment of counter j the game board is displayed with a message prompting the jth player to make a move (i.e., to save a word, delete a word, win, save a word and win, or resign), step 360. If the player's response, via the keyboard or other input device, is not comprehensible by the processor the player is prompted again.

Once a comprehensible move has been received by the processor, the processor prompts for confirmation of the move. This allows players to correct their typographical errors or other input errors before these errors are interpreted by the computer as intended entries. Non-confirmation, line 366, again transfers control back to step 360, in which the jth player is again prompted for a move; confirmation, line 367, allows the processor to proceed to process the move.

If the jth player (i.e., the acting player) chooses to resign, step 368, that player is eliminated, step 370. Then, if only one player remains, step 372, that sole remaining player is declared the winner and the game is over, step 374. If more than one player remains, step 372, after the resignation of the acting player, step 368, control is transferred back to step 356 and play continues.

If the jth player saves a word, step 376, then the letter combination entered by the player is checked to see whether it is an acceptable word and whether it has been previously saved or deleted, step 378. If the letter combination entered does not meet these conditions, step 378, the jth player's turn is nullified, step 380, and control returns to step 356. If the letter combination entered for saving is an acceptable word and has not been previously saved or deleted, step 378, then it is added to the list of saved words, step 382, and control returns to step 356.

If the jth player chooses to delete a word, step 384, then the letter combination entered is checked to determine whether it is an acceptable word and has not been saved or deleted previously, step 386. If the word does not meet these conditions, then the jth player's turn is nullified, step 388, and control returns to step 356. If the letter combination entered does meet these two conditions, then the word proposed for deletion is tentatively deleted, step 390, pending further checks to determine how many other players will still have existent solutions after the deletion of the proposed word. The further checks begin by examining the solutions (previously stored at step 341) for all players who are still active, to see if they contain the word proposed for deletion, step 392. In the cases of any players' solutions which contain the word, new solutions are sought without the deleted word, using the two-tree method of puzzle solution described above, step 394. Those players whose puzzles no longer possess solutions are marked for possible elimination from the game, step 396. When the continued existence of a solution has been checked for all players' puzzles, the number of players not marked for elimination is counted, step 398.

If no players would remain in the game in the event of deletion of the proposed word, step 398, then the proposed deletion is rejected, step 400, the word is restored to the lexicon, step 402, the jth player's turn is nullified, step 404, and control returns to step 356.

If only one player would remain in the game in the event of the deletion of the proposed word from the lexicon, step 398, then that one player is declared the winner and the game ends, step 406.

If two or more players would remain in the game in the event of the deletion of the proposed word from the lexicon, step 398, then the players marked in step 396 are eliminated, step 408, and the game continues with the remaining players; control transfers back to step 356.

If the jth player declares a "win" step 410 then two cases are examined: that of a simple win, in which no additional word is proposed for saving, and that of a save/win, in which one further word is proposed for saving, step 411. In the case of declaration of a simple win, the processor attempts to solve the jth player's puzzle, using only saved words as the allowable lexicon, step 412. If a solution exists using only saved words, step 414, then the jth player is declared the winner and the game is over, step 416.

If the processor cannot find a solution to the jth player's puzzle solely from among the saved words, step 414, the jth player is eliminated, step 418. The next event in the game then depends on the number of remaining players, step 420. If only one player remains, step 420, then the remaining player is declared the winner and the game is over, step 422. Otherwise, if more than one player remains, step 420, control is transferred from step 420 to step 356 and the game continues.

In the case in which the "win" declaration is accompanied by the proposal of one more word for saving, step 411, then the letter combination proposed as the saved word is checked by the processor to be certain that it is an acceptable word and has not been previously saved or deleted, step 424. If the proposed word fails to meet these two conditions, step 424, then the jth player's turn is nullified, step 426, and control transfers back to step 356. If the proposed word meets the required conditions, step 424, it is added to the list of saved words, step 428, and control transfers to step 412; from here the sequence of steps is identical to that for the case of a simple win declaration. Note that even if the win declaration fails and the jth player is eliminated in step 418, the saved word remains saved.

Figure 15:
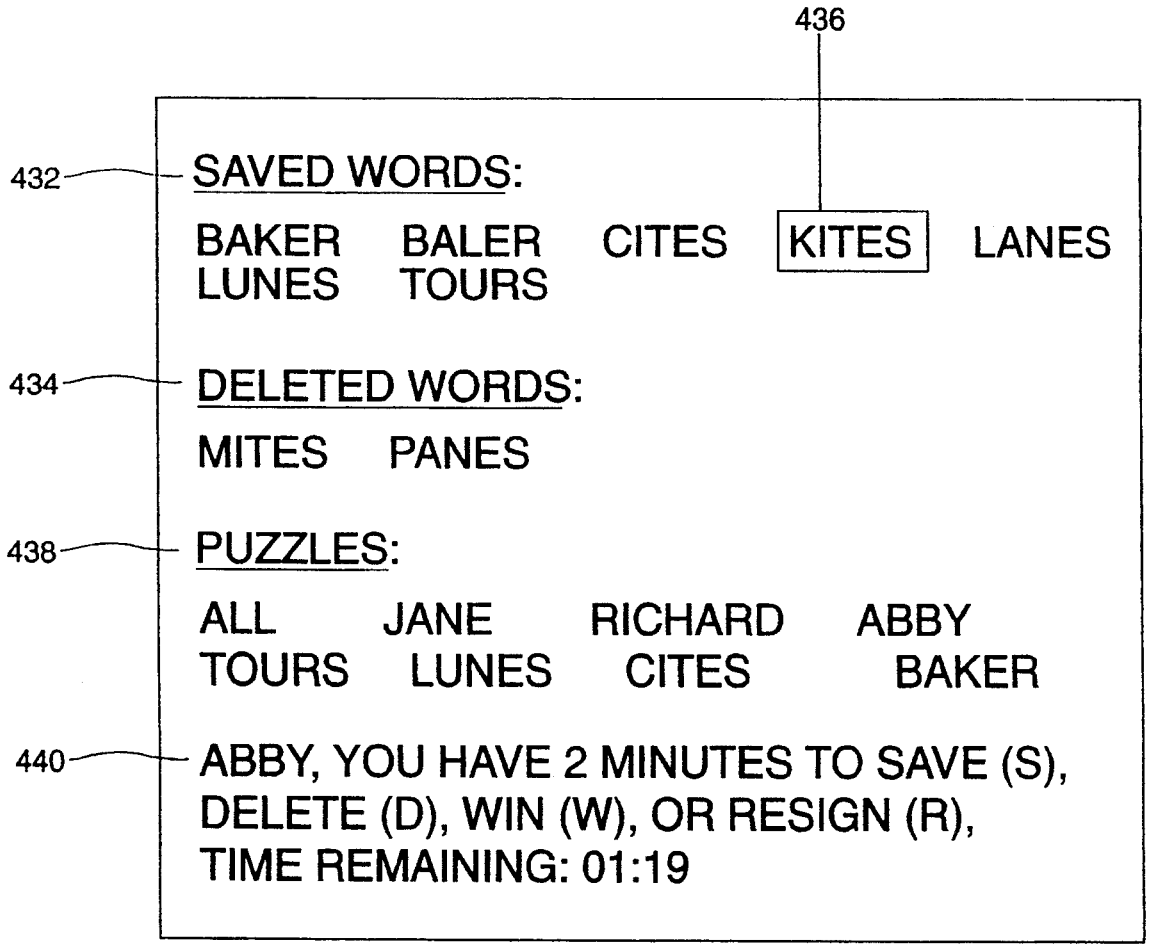
FIG. 15 is a simple realization of the display during a game, depicting the minimum information which must be conveyed to the players.

The display associated with the game must convey to the players all of the information that they require under the rules of the game. FIG. 15 shows the very simple display format as it might appear at a particular stage in a hypothetical game played by players named Jane, Richard and Abby, having separate puzzle words "lunes", "cites", and "baker", respectively, and common puzzle word "tours". It should be understood that any graphical design of the display is to be considered within the scope of the invention. Size of letters, colors, orientations, decorative elements, etc., may vary. What is important is that the display convey the information described as follows.

The display must indicate to the players the saved words, as indicated by reference numeral 432. These words may be displayed in alphabetical order, or in the order in which they were saved, or in some other order.

The display also must indicate to the players the deleted words, as indicated by reference numeral 434. Likewise, these words may be displayed in alphabetical order, or in the order in which they were deleted, or in some other order.

The last word played, indicated by reference numeral 436, is displayed in a fashion that makes it possible for the players to see the last move at a glance. Accordingly, the word might be displayed in uppercase, in bold letters, in reverse video, in a different color, etc.

The display must show the puzzle words 438, consisting of the common puzzle word and the words assigned to each player, and identify them as such.

The display must contain a message area 440 for displaying prompts or other messages to the players. The message area may be eliminated from the display if suitable signals or messages are delivered to the players audibly.

Figure 16:
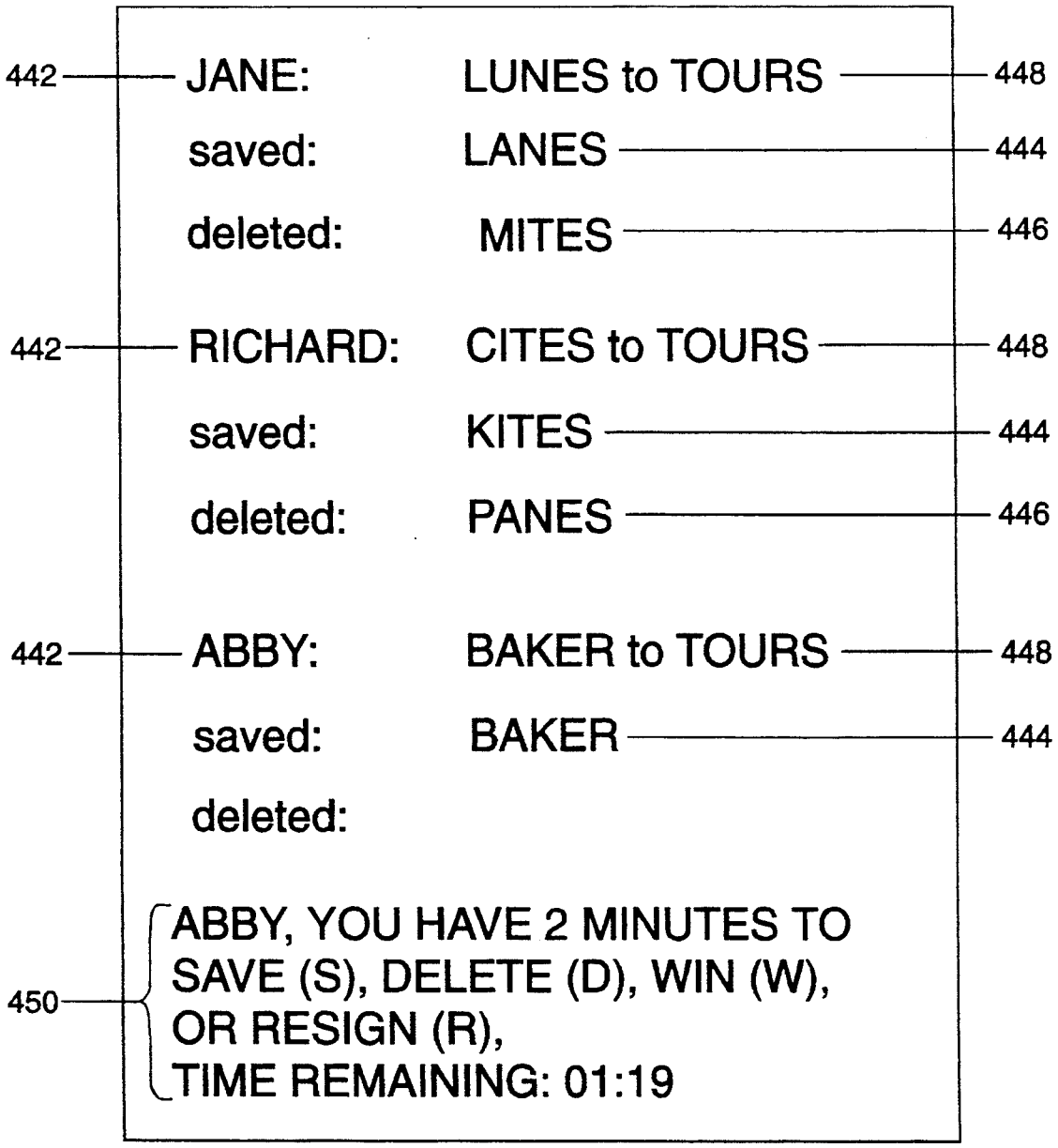
FIG. 16 is a simple realization of the display during a game, conveying additional information to the players.

Alternative forms of the display may convey additional information. For example, FIG. 16 shows another simple realization of the display which meets all of the above requirements, but additionally displays the saved and deleted words in such a fashion as to indicate which player deleted or saved each one. Each player's name 442 is followed by a listing of the words 444 saved by him, and of the words 446 deleted by him, as well as indicating that player's two puzzle words. The message area 448 is the same as that of FIG. 15. The game board of FIG. 16 has the effect of simplifying the game as compared with the display of FIG. 15, since players need not keep track for themselves of other players' moves; rather, this is done for them in the display. A commercial version of the present invention might allow the players to select among various display configurations, all of which meet the minimum criteria specified and described in FIG. 15, but which may include additional information. Also, audio cues such as bells, beeps or voice messages may be used to prompt or to convey information to the players.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method of solving word transformation puzzles by transforming a first word into a second word in the shortest possible sequence, the steps comprising:

a) growing a first tree having a plurality of adjacent nodes with words disposed thereon, the root node of said first tree having said first word disposed thereon;

b) generating one or more words for each of said nodes occurring in the topmost level of said first tree, each of said generated words having a predetermined relationship to the word from which it was generated;

c) growing a second tree having a plurality of adjacent nodes with words disposed thereon, the root node of said second tree having said second word disposed thereon;

d) generating one or more words for each of said nodes occurring in the topmost level of said second tree, each of said generated words having a predetermined relationship to the word from which it was generated;

e) comparing at least one word of said first tree with at least one word of said second tree in order to identify a word common to both of said trees;

f) identifying a sequence of words in each of said trees connecting the respective roots thereof to said common word; and g) combining said first and second sequences of words into a single sequence connecting the respective roots of said trees to one another via said common word.

2. The method of solving word transformation puzzles in accordance with claim 1, the steps further comprising:

h) avoiding circuits in each of said trees by eliminating generated words which duplicate words previously generated therein and by eliminating generated words duplicative of the root thereof.

3. The method of solving word transformation puzzles in accordance with claim 1, wherein said comparing step (e) is performed for each word in a given level of each of said trees prior to adding additional levels thereto, so that the number of words in the solution sequence is minimized.

4. The method of solving word transformation puzzles in accordance with claim 1, wherein said word-generating steps (b) and (d) are performed successively on the respective tree having the fewest nodes in its topmost level, so that the solution of the puzzle is accomplished using minimal memory.

5. The method of solving word transformation puzzles in accordance with claim 1, wherein said predetermined relationship of words on adjacent nodes comprises a difference of a single character between said words, each word containing an identical number of characters.

6. The method of solving word transformation puzzles in accordance with claim 5, wherein newly-generated words are formed for each of said generator words by substituting individual letters successively for each letter of said generator word to form a number of character strings for each of said generator words.

7. The method of solving word transformation puzzles in accordance with claim 5, the steps further comprising:

i) comparing each of said character strings with a list of acceptable words having the same number of letters as said character strings; and j) eliminating those of said character strings that are not located in said list of acceptable words.

8. The method of solving word transformation puzzles in accordance with claim 1, wherein said predetermined relationship of words on adjacent nodes comprises a recombination of letters between said words, each word containing an identical number of characters.

9. The method of solving word transformation puzzles in accordance with claim 8, wherein character strings are generated by recombining the letters of each generator word to form a number of permutations thereof.

10. The method of solving word transformation puzzles in accordance with claim 9, the steps further comprising:

i) comparing each of said character strings with a list of acceptable words words having the same number of letters as said character strings; and j) eliminating those of said character strings that are not located in said list of acceptable words.

11. The method of solving word transformation puzzles in accordance with claim 1, the steps further comprising:

h) displaying at least some of said sequence of words.

12. The method of solving word transformation puzzles in accordance with claim 1, wherein data representative of each of said words disposed on the nodes of said trees are stored in a memory, whereby the sequence of words from the respective root to any word in said tree can be recovered.

13. A computer-based game for one or more players, the object of which game is to transform a first word into a second word through a sequence of words, in accordance with a set of predetermined rules, said computer-based game comprising:

a) means for growing a first tree having a plurality of adjacent nodes with words disposed thereon, the root node of said first tree having said first word disposed thereon;

b) means for generating one or more words for each of said nodes occurring in the topmost level of said first tree, each of said generated words having a predetermined relationship to the word from which it was generated;

c) means for growing a second tree having a plurality of adjacent nodes with words disposed thereon, the root node of said second tree having said second word disposed thereon;

d) means for generating one or more words for each of said nodes occurring in the topmost level of said second tree, each of said generated words having a predetermined relationship to the word from which it was generated;

e) means for comparing at least one word of said first tree with at least one word of said second tree in order to identify a word common to both of said trees;

f) means for identifying a sequence of words in each of said trees connecting the respective roots thereof to said common word; and g) means for combining said first and second sequences of words into a single sequence connecting the respective roots of said trees to one another via said common word.

14. The computer-based game in accordance with claim 13, further comprising:

h) means for avoiding circuits in each of said trees by eliminating generated words which duplicate words previously generated therein and by eliminating generated words duplicative of the root thereof.

15. The computer-based game in accordance with claim 14, the steps further comprising:

i) means for forming new character strings from words, and for comparing each of said character strings with a list of acceptable words; and j) means for eliminating those of said character strings that are not located in said list of acceptable words.

16. The computer-based game in accordance with claim 15, further comprising:

k) means for displaying at least some of said sequence of words.

17. The computer-based game in accordance with claim 13, wherein said game is disposed in a self-contained device for ease of use in social situations.

18. The computer-based game in accordance with claim 13, wherein at least a portion of said game is disposed in a replaceable data medium compatible with a video game processing unit having a game control device adapted for use therewith.

19. The computer-based game in accordance with claim 18, further comprising:

h) means for displaying at least some of said sequence of words.

* * * * *